US011466939B2

(12) United States Patent
Tong

(10) Patent No.: US 11,466,939 B2
(45) Date of Patent: Oct. 11, 2022

(54) HEADER ASSEMBLY FOR HEAT EXCHANGER AND HEAT EXCHANGER

(71) Applicant: SANHUA (HANGZHOU) MICRO CHANNEL HEAT EXCHANGER CO., LTD., Hangzhou (CN)

(72) Inventor: Zhongyao Tong, Beijing (CN)

(73) Assignee: SANHUA (HANGZHOU) MICRO CHANNEL HEAT EXCHANGE CO., LTD.

( * ) Notice: Subject to any disclaimer, the term of this patent is extended or adjusted under 35 U.S.C. 154(b) by 26 days.

(21) Appl. No.: 17/039,913

(22) Filed: Sep. 30, 2020

(65) Prior Publication Data

US 2021/0088294 A1 Mar. 25, 2021

Related U.S. Application Data

(63) Continuation of application No. PCT/CN2018/107286, filed on Sep. 25, 2018.

(30) Foreign Application Priority Data

Mar. 30, 2018 (CN) ..... 201820447674.X

(51) Int. Cl.
*F28F 9/02* (2006.01)
*F28D 7/16* (2006.01)

(52) U.S. Cl.
CPC . *F28F 9/02* (2013.01); *F28D 7/16* (2013.01)

(58) Field of Classification Search
CPC ..... F28F 9/02; F28D 7/16
(Continued)

(56) References Cited

U.S. PATENT DOCUMENTS

2008/0041095 A1* 2/2008 Higashiyama ..... F28D 1/05391 62/515
2009/0007592 A1* 1/2009 Higashiyama ..... F28D 1/05391 62/515

(Continued)

FOREIGN PATENT DOCUMENTS

CN 1536312 A 4/2003
CN 206177081 U 10/2016

(Continued)

OTHER PUBLICATIONS

No Author. International Application No. PCT/CN2018/107286, International Search Report and Written Opinion, dated Jan. 4, 2019.

*Primary Examiner* — Davis D Hwu
(74) *Attorney, Agent, or Firm* — Perkins Coie LLP

(57) ABSTRACT

A header assembly and a heat exchanger having the same are provided. The header assembly includes at least one header group, the header group includes a plurality of main header sections, the main header section is provided with at least one through groove, the through groove extends in a same direction as an axis of the main header section, and the plurality of main header sections in the header group are communicated with one another. In the header group, the main header section extends along a first direction, and the plurality of main header sections are sequentially arranged along a second direction. An included angle between the first direction and the second direction is greater than 0°.

20 Claims, 18 Drawing Sheets

(58) Field of Classification Search
USPC ..... 165/175
See application file for complete search history.

(56) References Cited

U.S. PATENT DOCUMENTS

| | | | | |
|---|---|---|---|---|
| 2009/0282850 | A1* | 11/2009 | Higashiyama ..... | F28F 9/0278 62/239 |
| 2012/0291998 | A1 | 11/2012 | Newman | |

FOREIGN PATENT DOCUMENTS

| | | | |
|---|---|---|---|
| CN | 206626991 | U | 1/2017 |
| EP | 1479993 | A2 | 11/2004 |

* cited by examiner

HEADER ASSEMBLY FOR HEAT EXCHANGER AND HEAT EXCHANGER

CROSS-REFERENCE TO RELATED APPLICATIONS

The present document is a continuation of and claims priority to International Patent Application No. PCT/CN2018/107286, filed on Sep. 25, 2018 which further claims the benefit of priority of Chinese Patent Application No. 201820447674.X, filed on Mar. 30, 2018. The content of the above-identified applications is incorporated herein by reference in its entirety.

FIELD

The present disclosure relates to a technical field of heat exchangers, and more particularly to a header assembly for a heat exchanger and a heat exchanger having the header assembly.

BACKGROUND

A multi-channel heat exchanger in the related art includes two header assemblies arranged in parallel and several flat tubes inserted in parallel between the two header assemblies, and a fin is arranged between two adjacent flat tubes.

The header assembly is a key part of the multi-channel heat exchanger, and is configured to distribute the refrigerant to the flat tubes at an inlet and to collect the refrigerant after heat exchange in the flat tubes at an outlet. Generally, a cylindrical header assembly is provided with a groove, and the flat tube is inserted into the groove and then integrally welded in a high-temperature furnace. In the conventional design of the header assembly, the groove for the flat tube usually is a radial opening, so that a diameter of the header assembly needs to be designed according to a width of the flat tube. An outer diameter of the header assembly needs to be greater than a sum of the width of the flat tube and a wall thickness of the header assembly. To ensure the strength of the heat exchanger, the thickness generally needs to be more than 1.5 mm. The larger the outer diameter is, the larger the thickness needs to be. Therefore, from the perspective of the whole heat exchanger, the volume and the weight of the header assembly both account for a large proportion.

SUMMARY

In a first aspect, embodiments of the present disclosure provide a header assembly for a heat exchanger. A hydraulic diameter of the header assembly is not affected by a size of a through groove.

In a second aspect, embodiments of the present disclosure provides a heat exchanger.

The header assembly for the heat exchanger according to the embodiments of the present disclosure includes at least one header group, the header group includes a plurality of main header sections, the main header section is provided with at least one through groove, the through groove extends in a same direction as an axis of the main header section, and the plurality of main header sections in the header group are communicated with one another. In the header group, the main header section extends along a first direction, and the plurality of main header sections are sequentially arranged along a second direction. An included angle between the first direction and the second direction is greater than 0°.

In the header assembly for the heat exchanger according to the embodiments of the present disclosure, a hydraulic diameter of the header assembly is not affected by a size of the through groove, thereby reducing the volume and the weight of the header assembly.

The heat exchanger according to the embodiments of the present disclosure includes at least one heat exchange group, and the heat exchange group includes a plurality of flat tubes, a fin and a header assembly. The plurality of flat tubes are spaced apart from one another and the fin is arranged between two adjacent flat tubes. The header assembly includes at least one header group, the header group includes a plurality of main header sections, the main header section is provided with at least one through groove, the through groove extends in a same direction as an axis of the main header section, and the plurality of main header sections in the header group are communicated with one another. In the header group, the main header section extends along a first direction, and the plurality of main header sections are sequentially arranged along a second direction. An included angle between the first direction and the second direction is greater than 0°. An end of the flat tube is connected to a corresponding through groove in the header assembly.

In the heat exchanger according to the embodiments of the present disclosure, a hydraulic diameter of the header assembly in the heat exchanger is not affected by a size of the through groove, thereby reducing proportions of the volume and the weight of the header assembly in the whole heat exchanger.

DETAILED DESCRIPTION

In the related art, a header assembly employs a columnar structure, and the volume inside the header assembly is much larger than the volume of a flat tube micropore, which has a great influence on a refrigerant charge. Certainly, a smaller diameter of the header assembly may not be better. From the perspective of heat exchange, an excessively small header assembly may lead to too much fluid resistance in the header, which greatly increases a pressure drop of the refrigerant. From the perspective of a production process, the excessively small header assembly requires a deep hole machining technology, which is difficult and costly.

Figure 19:
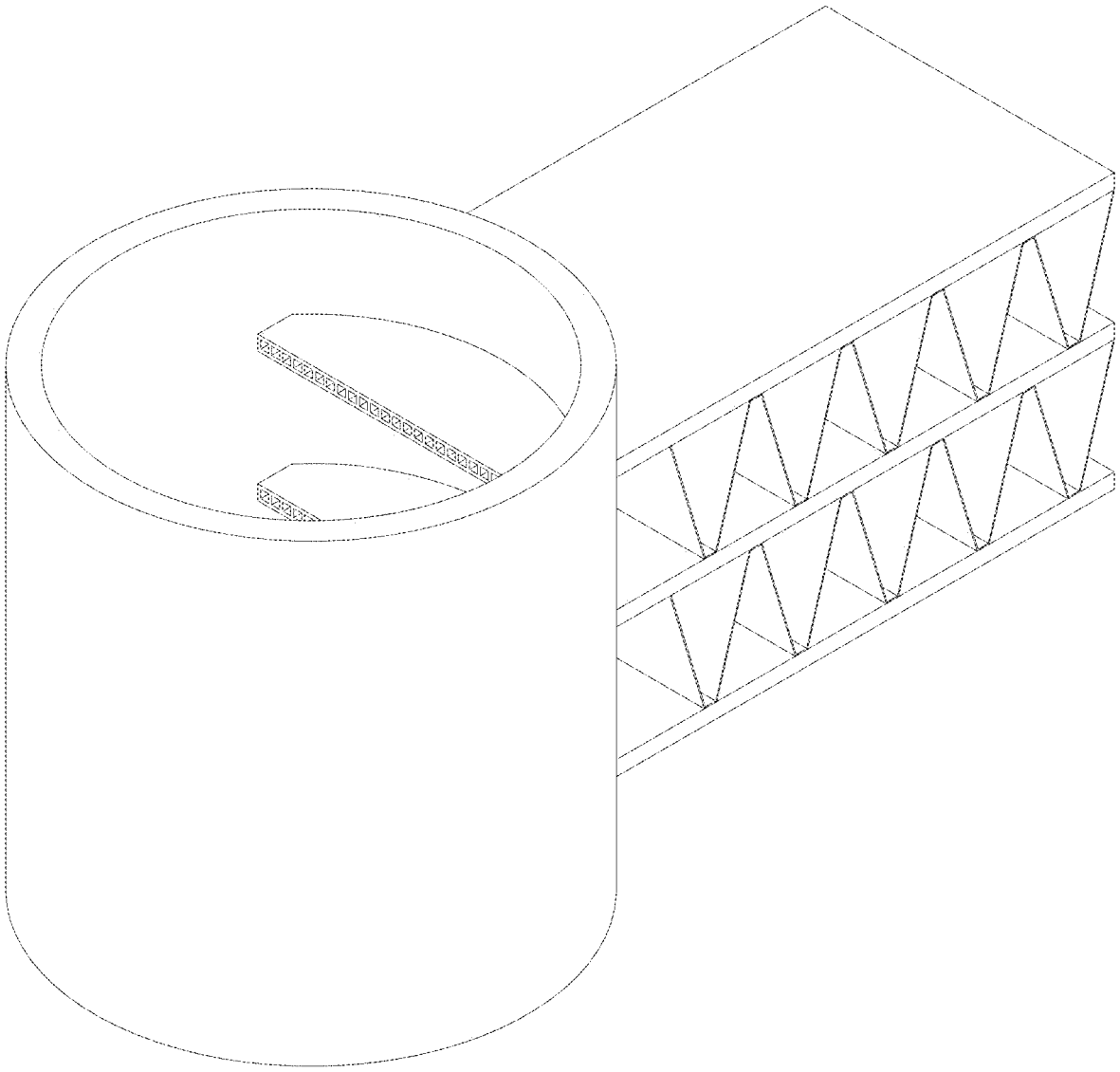
FIG. 19 is a schematic view of a heat exchanger in the related art.

A fitting form of a conventional circular header assembly and a flat tube is illustrated in FIG. 19. From the perspective of geometry, an inner diameter of the circular header at least needs to be larger than a width of the flat tube. In order to prevent the micropores in ends of the flat tubes from be blocked by welding, an inner wall of the header assembly further needs to be kept a certain gap from a side wall of the flat tube. In addition, according to strength requirements, a header wall of the header assembly also needs to maintain a certain thickness. Based on the above, the diameter of the header assembly in the related art is subject to a number of restrictions and difficult to miniaturize.

To this end, the present disclosure provides a header assembly 1 with a new structure.

The embodiments of the present disclosure are described in detail below. Examples of the embodiments are illustrated in the accompanying drawings, where the same or similar reference numerals throughout the specification represent the same or similar elements or elements having the same or similar functions. Embodiments described below with reference to the accompanying drawings are exemplary and are intended to explain the present disclosure and cannot be understood as limitations on the present disclosure.

Referring to FIG. 1 to FIG. 18, the header assembly 1 for a heat exchanger 100 according to the embodiments of the present disclosure includes at least one header group 102, the header group 102 includes a plurality of main header sections 11, the main header section 11 is provided with at least one through groove 101, and the through groove 101 extends in the same direction as an axis of the main header sections 11. For example, when the main header section 11 extends along a first direction, the through groove 101 also extends along the first direction. Certainly, the main header section 11 and the through groove 101 may extend in a straight line or in a curved line, as long as generally along one direction. The plurality of main header sections 11 in the header group 102 are communicated with one another.

In addition, the through groove 101 extending in the same direction as the axis of the main header sections 11 means that the through groove 101 may be parallel to the axis of the main header sections 11, or a relatively small included angle (for example, less than 10°, etc.) may be formed between the through groove 101 and the axis of the main header sections 11.

According to the header assembly 1 for the heat exchanger 100 in the embodiment of the present disclosure, the through groove 101 is configured to extend in the same direction as the axis of the main header sections 11, so that a hydraulic diameter of the header assembly 1 is not affected by a size of the through groove 101.

Since the present disclosure avoids the effects of the size of the through groove 101 on the hydraulic diameter of the header assembly 1, the diameter of the header assembly 1 can be greatly reduced, and the weight and size of the header assembly 1 can also be reduced, thereby reducing the used materials and being more environmentally friendly. Moreover, the refrigerant charge can also be reduced accordingly.

In addition, the diameter of the header assembly 1 is greatly reduced, thus reducing a windward area of the header assembly 1 and increasing windward areas of the flat tube 2 and the fin 3. All these areas may be converted into an effective heat exchange area to improve the heat exchange efficiency. Moreover, the area of the overall header wall is greatly reduced, and the thickness of the header wall can be reduced under the condition of meeting the same strength requirements. In addition, since the hydraulic diameter of the header assembly 1 is reduced, the refrigerant charge can be greatly reduced.

Figure 5:
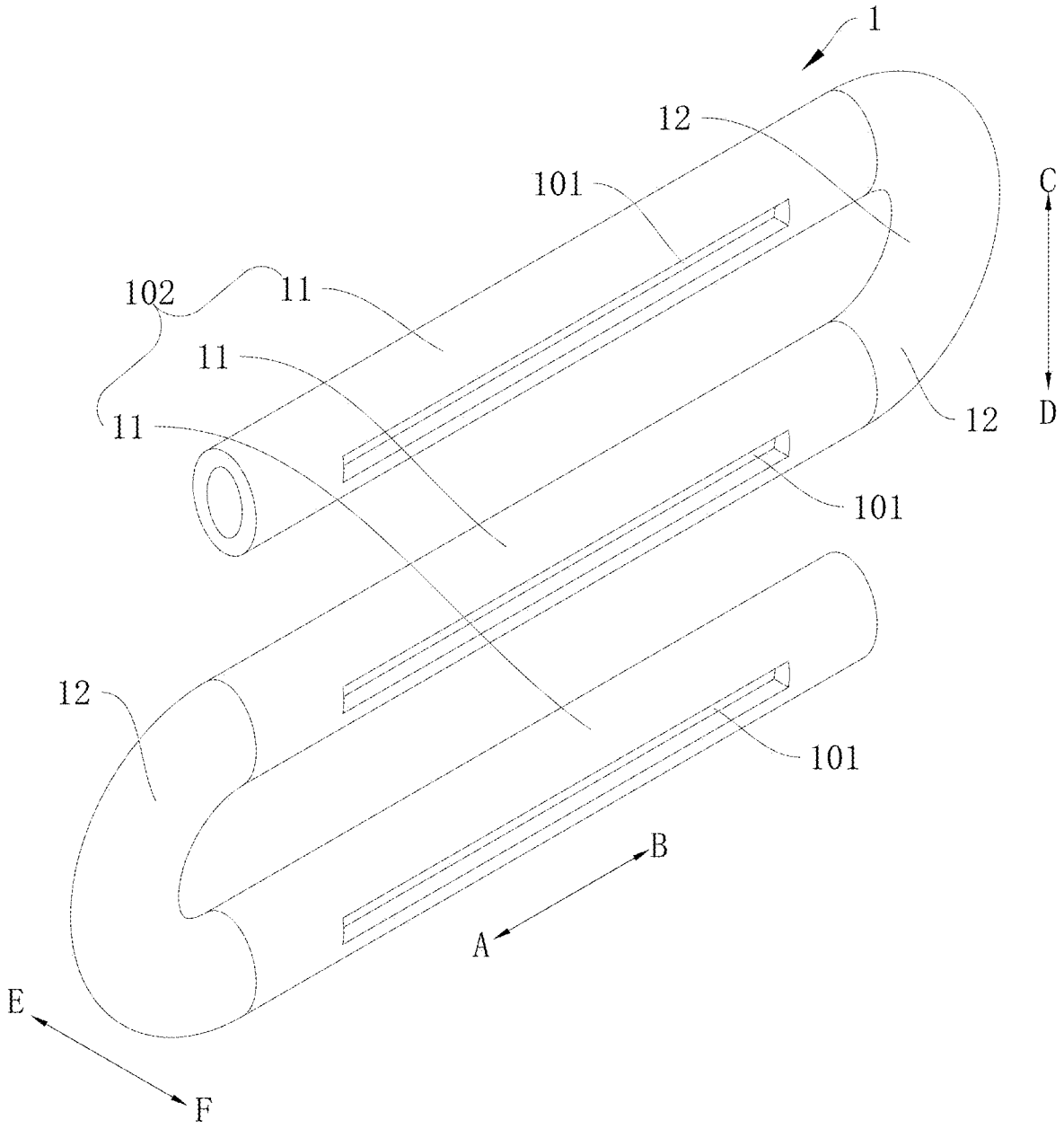
FIG. 5 is a schematic view of a header assembly for a heat exchanger according to an embodiment of the present disclosure.
Figure 6:
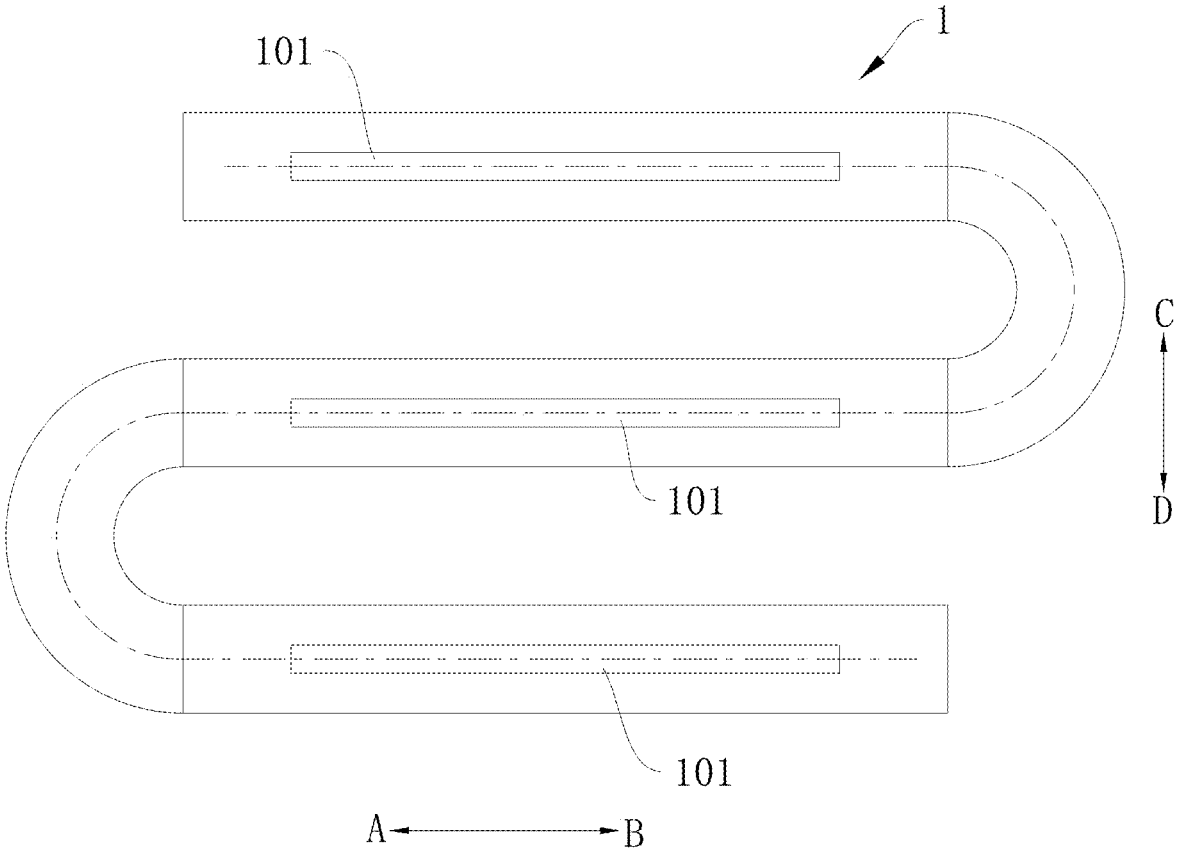
FIG. 6 is a side view of the header assembly along direction F→E in FIG. 5.

As illustrated in FIG. 5, in some embodiments of the present disclosure, in the header group 102, the main header section 11 extends along a first direction (with reference to a direction A→B in FIG. 5). It should be noted that the through groove 101 in the main header section 11 extends in the same direction as the main header section 11, and hence the through groove 101 also extends along the first direction.

Further, the main header sections 11 in the header group 102 are sequentially arranged along a second direction (with reference to a direction C→D in FIG. 5), and an included angle formed between the first direction and the second direction is greater than 0°.

The through groove 101 formed in the header wall of the main header section 11 may be used to connect with the flat tube 2, etc. During the flow of the refrigerant along the header assembly 1, the refrigerant may be led to other elements such as the flat tube 2 via the through groove 101.

In addition, in the present disclosure, the hydraulic diameter of the header assembly 1 is not affected by the size of the through groove 101, and the hydraulic diameter of the header assembly 1 may be far less than a length of the through groove 101, so as to achieve the purpose of reducing the size of the header assembly 1.

It should be noted that the included angle between the first direction and the second direction is greater than 0°. In some embodiments, the first direction and the second direction may be roughly perpendicular to each other. That is, the included angle between the first direction and the second direction may be 90° or approximately 90°. For example, the included angle between the first direction and the second direction is configured to be between 30° and 90°.

In addition, the plurality of main header sections 11 in the header group may be connected with one another in series to form one fluid channel, and the plurality of main header sections 11 may be connected with one another in parallel or in series and in parallel to form a plurality of fluid channels. The plurality of main header sections 11 being connected with one another in parallel includes that the plurality of main header sections 11 are connected to a same connecting header section 12.

For the convenience of description, the present disclosure may refer to a third direction (a direction E→F), and the third direction is perpendicular to both the first direction and the second direction.

In the present disclosure, the plurality of main header sections 11 in the header group 102 may be connected into a variety of different forms through the connecting header section 12. The connecting header section 12 and the main header section 11 may be separate structures, or may be an integral structure formed by bending. However, the main header sections 11 may be communicated not only through the connecting header section 12, but also by other means, or the plurality of main header sections 11 are directly connected and communicated. Some examples are given in the present disclosure, but they are not intended to limit the protection scope of the present disclosure.

Embodiment 1

Referring to FIG. 1 to FIG. 8, the plurality of main header sections 11 in the header group 102 are end-to-end connected sequentially to form a circuitous fluid channel. Since the header group 102 extends in a circuitous manner, which is different from a large-size straight header in the related art, and the size of the header assembly 1 is not affected by the size such as the width of the flat tube 2, the size of the header assembly 1 can be reduced. After the circuitous channel is formed, the refrigerant can flow along the circuitous channel.

In some embodiments, the header assembly 1 extends circuitously into a serpentine shape. The serpentine-shaped circuitous header is easy to connect with elements such as the flat tube 2.

The serpentine extension of the header assembly 1 is formed by reciprocating extensions of the header assembly 1. For example, referring to FIG. 6, when three main header sections 11 are provided, one end of the header assembly 1 starts to extend along the direction A→B (one main header section 11), then along the direction B→A (another main header section 11), then along the direction A→B again (yet another main header section 11), and so on. That is, in FIG. 6, a first main header section 11 in the plurality of main header sections 11 extends along the direction A→B, a B end of the first main header section 11 is connected to a first connecting header section 12, the first connecting header section 12 extends along the direction C→D (extending in a curved or straight direction), a D end of the first connecting header section 12 is connected to a second main header section 11, the second main header section 11 extends along the direction B→A, an A end of the second main header section 11 is connected to a second connecting header section 12, the second connecting header section 12 extends along the direction C→D (extending in a curved or straight direction), a D end of the second connecting header section 12 is connected to a third main header section 11, and the third main header section 11 extends along the direction A→B, so as to form the serpentine extension. When the main header sections 11 in other quantities intend to extend in a serpentine manner, the previous descriptions can be followed.

Embodiment 2

Different from Embodiment 1, the main header sections 11 in the header group 102 are connected by the same connecting header section 12. That is, the connecting header section 12 connects the plurality of main header sections 11 in the header group 102 in parallel. The refrigerant may be diverted to the plurality of main header sections 11 through the connecting header section 12, and the refrigerant from the plurality of main header sections 11 may also be converged to the connecting header section 12. A parallel structure is employed to make the quantity of the refrigerant in each main header section more uniform, so as to achieve better heat exchange efficiency and higher heat exchange uniformity.

For example, as shown in FIG. 12 to FIG. 16, the header assembly 1 includes one header group 102, the plurality of main header sections 11 in the header group 102 are arranged along the second direction, each main header section 11 extends along the first direction, the connecting header section 12 is arranged at one end of the header group 102 and extends along the second direction, one end of each main header section 11 in the header group 102 is in communication with the connecting header section 12, and the other end thereof is sealed.

For another example, the header assembly 1 includes a plurality of header groups 102, and at least two header groups 102 in the plurality of header groups 102 are connected by the same connecting header section 12, for simplifying the structure of the header assembly 1. Specifically, the header assembly 1 includes a plurality of header groups 102, the plurality of header groups 102 are communicated by the connecting header section 12 extending along the second direction, the plurality of main header sections 11 in each header group 102 are arranged along the second direction, and the plurality of header groups 102 are arranged around the connecting header section 12.

Figure 15:
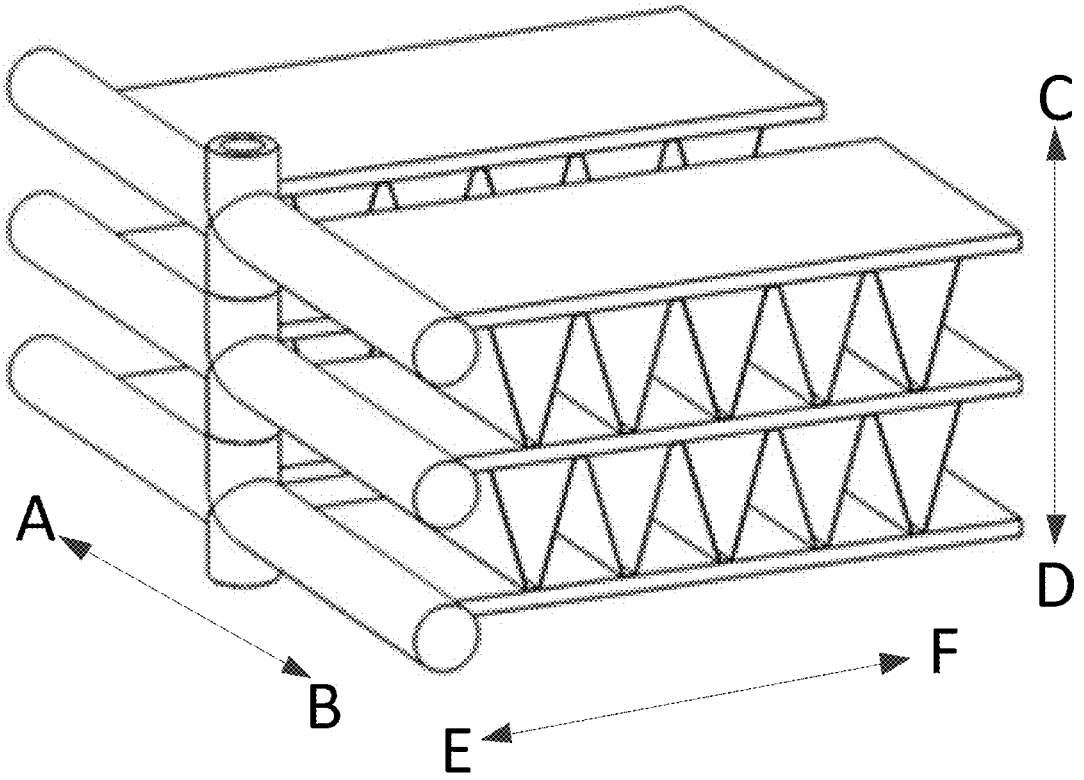
FIG. 15 is a schematic view of a heat exchanger according to another embodiment of the present disclosure.
Figure 16:
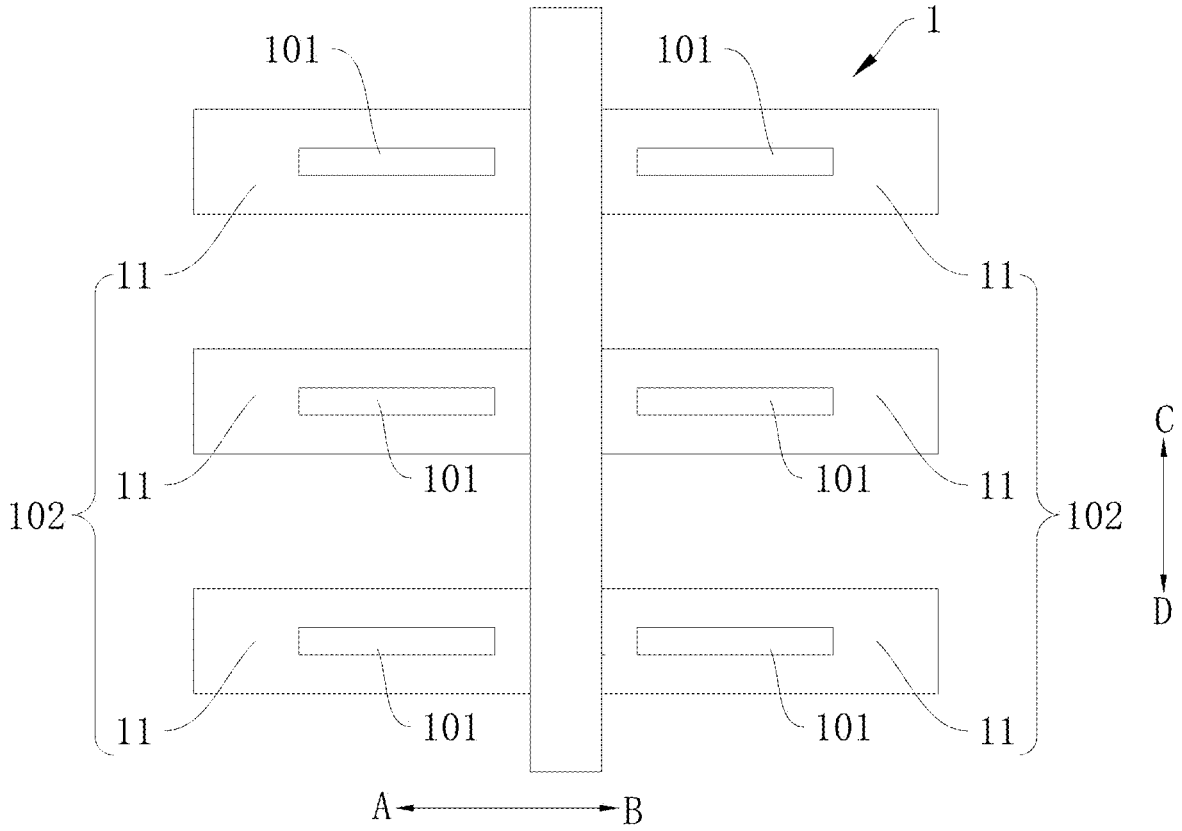
FIG. 16 is a schematic view of a header assembly for a heat exchanger according to another embodiment of the present disclosure.

Specifically, as shown in FIG. 15, the header assembly 1 includes two header groups 102, the header group 102 includes a plurality of main header sections 11, and the plurality of main header sections 11 in the header group 102 are arranged along the second direction and the main header section 11 extends along the first direction. The connecting header section 12 may be arranged between the two header groups 102, and the connecting header section 12 extends along the second direction. One end of each main header section 11 in the two header groups 102 is communicated with the connecting header section 12, and the other end thereof is sealed. The connecting header section 12 which extends in an arrangement direction of the main header sections 11 is employed, and at least two header groups 102 are communicated with the same connecting header section 12, which not only saves space, but also distributes the refrigerant more evenly.

Embodiment 3

Figure 17:
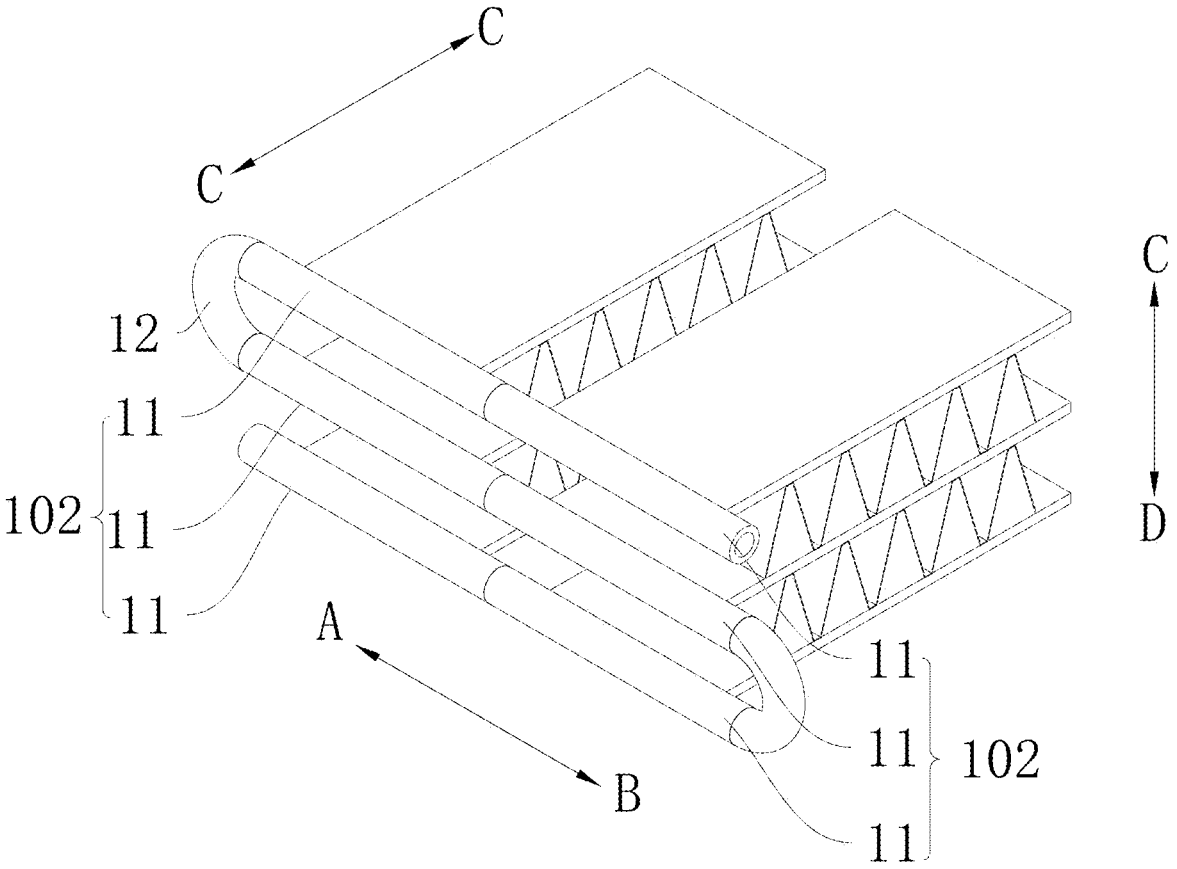
FIG. 17 is a schematic view of a heat exchanger according to another embodiment of the present disclosure.

As illustrated in FIG. 17, different from Embodiment 1 and Embodiment 2, a plurality of through grooves 101 are formed in the main header section 11 and spaced apart from one another, and the plurality of main header sections 11 may be connected in the form of Embodiment 1 or Embodiment 2.

In addition, when the main header section 11 is provided with the plurality of through grooves 101, arrangement positions of the plurality of through grooves 101 may be selected according to an actual situation. For example, the plurality of through grooves 101 in the main header section 11 are arranged to be in a form of surrounding an axis of the main header sections 11. For another example, the plurality of through grooves 101 in the main header section 11 are arranged to be in a form of being spaced apart from one another along an extension direction of the main header section. For another example, the plurality of through grooves 101 in the main header section 11 are arranged to be in an array form of being arranged along the extension direction of the main header section 11 and around the main header section 11.

As illustrated in FIG. 17, the plurality of main header sections 11 are connected in a serpentine shape by the connecting header sections 12, and the main header section 11 is provided with two through grooves 101 spaced apart along the first direction.

Embodiment 4

In the above embodiments, the connecting header section 12 is a curved pipe, a straight pipe or a polyline-shaped pipe, etc.

In addition, a cross section of the connecting header section 12 is round, square or oval.

As illustrated in FIG. 1 to FIG. 6, both the connecting header section 12 and the main header section 11 are round pipes. That is, the section of the connecting header section 12 perpendicular to its axis and the section of the main header section 11 perpendicular to its axis are round. The connecting header section 12 is an arc pipe. In other words, a center line of the connecting header section 12 is an arc line.

Figure 7:
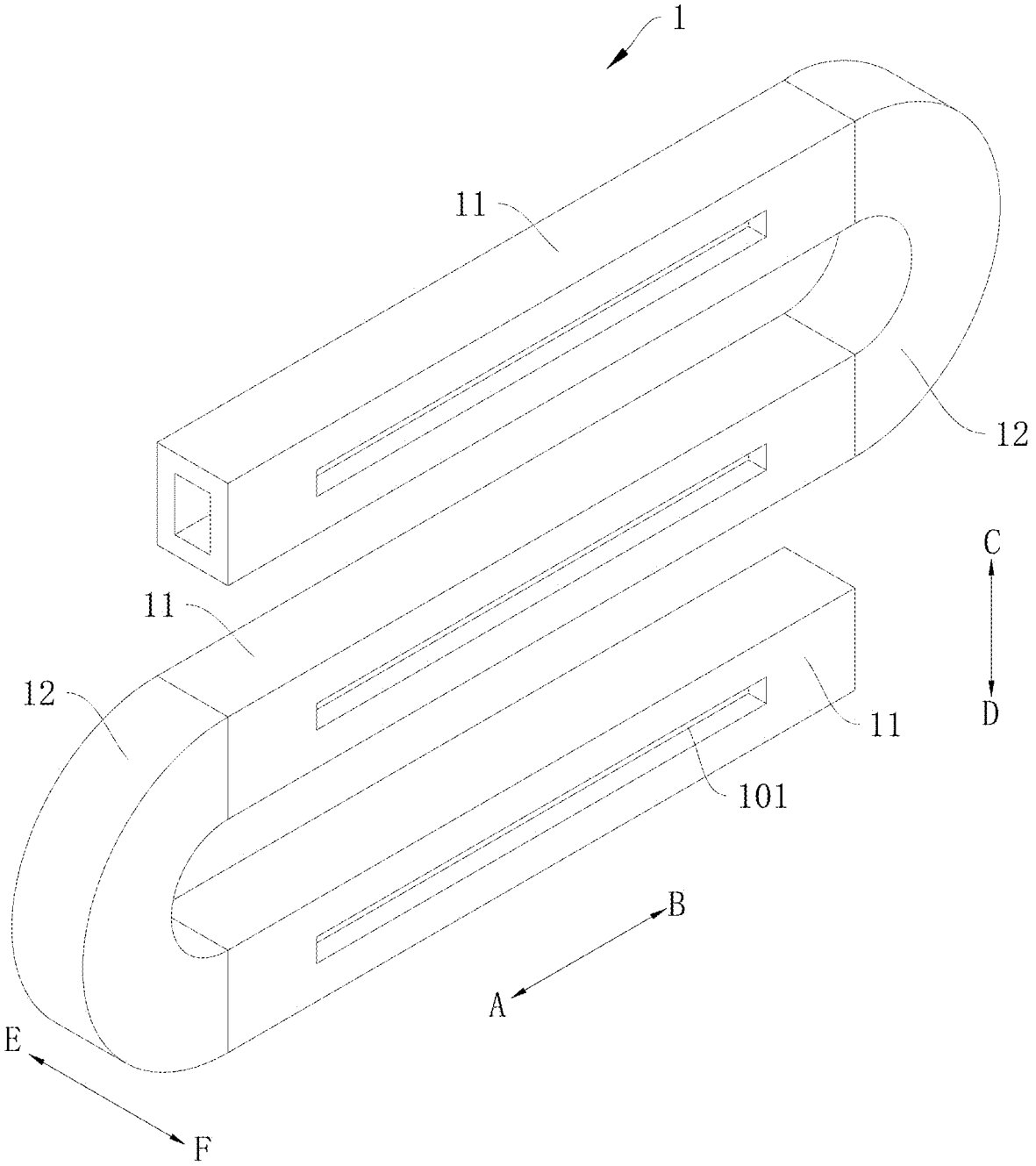
FIG. 7 is a schematic view of a header assembly for a heat exchanger according to another embodiment of the present disclosure.

As illustrated in FIG. 7, both the connecting header section 12 and the main header sections 11 are square pipes. That is, the section of the connecting header section 12 perpendicular to its axis and the section of the main header section 11 perpendicular to its axis are square. The connecting header section 12 has an arc shape. In other words, the center line of the connecting header section 12 is an arc line.

Figure 8:
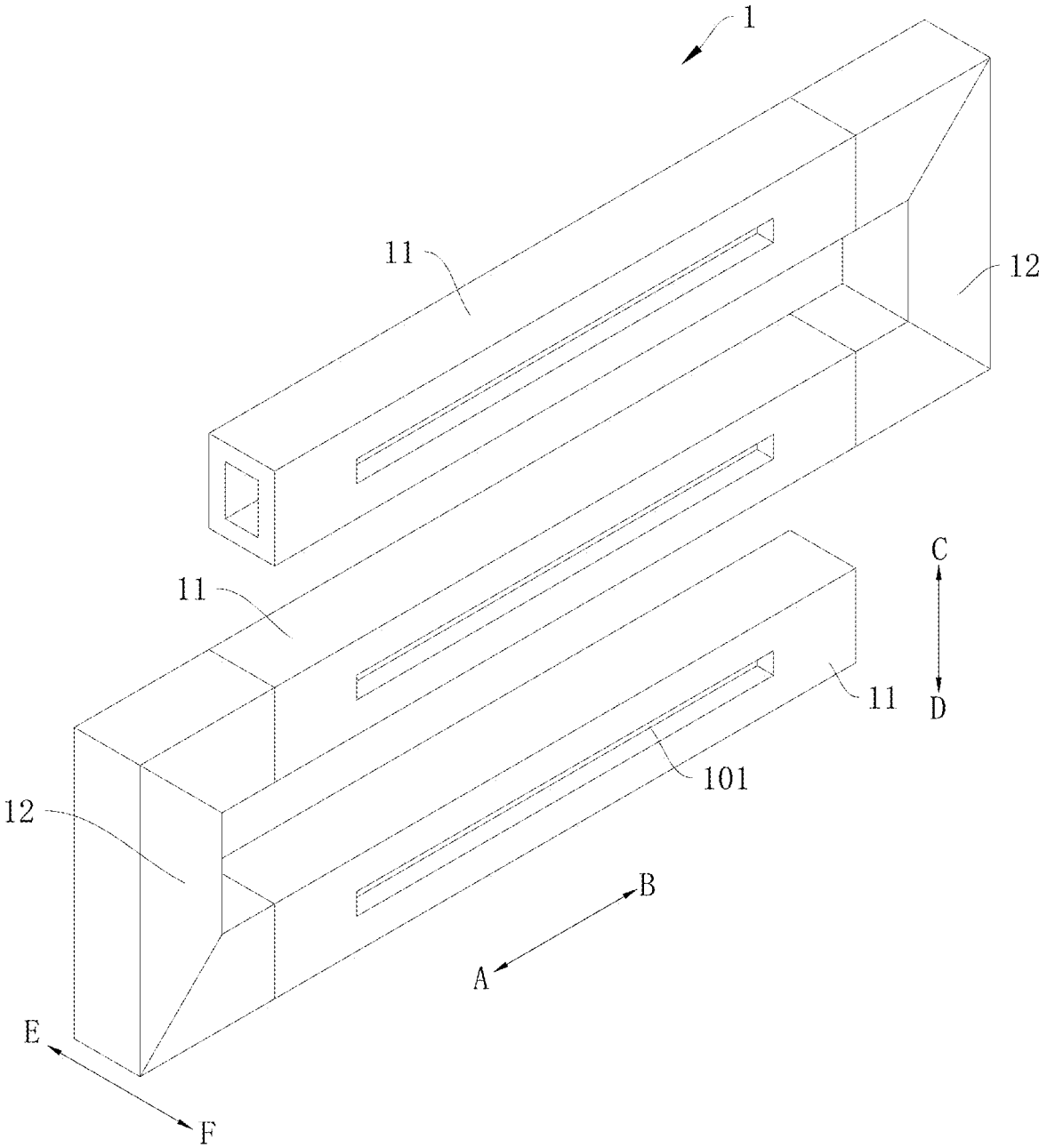
FIG. 8 is a schematic view of a header assembly for a heat exchanger according to another embodiment of the present disclosure.

As illustrated in FIG. 8, both the connecting header section 12 and the main header section 11 are square pipes. That is, the section of the connecting header section 12 perpendicular to its axis and the section of the main header section 11 perpendicular to its axis are square. The connecting header section 12 is a polyline-shaped pipe. In other words, the center line of the connecting header section 12 is a polyline.

Figure 9:
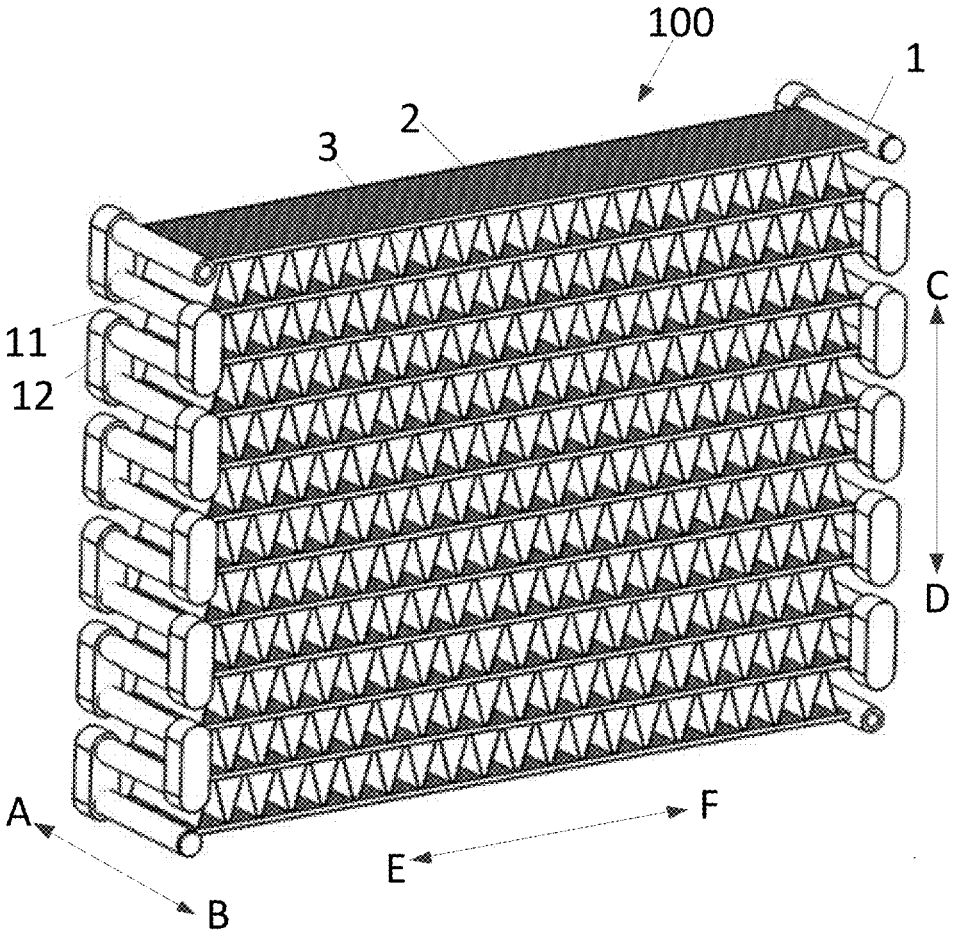
FIG. 9 is a schematic view of a heat exchanger according to another embodiment of the present disclosure.

As illustrated in FIG. 9, the connecting header section 12 is in a shape of a box body. Specifically, the connecting header section 12 is a hollow column with two closed ends, including a circumferential wall and an end plate. A cross section (a section perpendicular to an axis) of the circumferential wall is annular, and the cross section of the circumferential wall may be oblong, elliptic, circular, square or in other shapes. Two ends of the circumferential wall along the direction of the axis are both closed by the end plates. One end plate is provided with two connecting holes, and ends of the corresponding two main header sections 11 are in communication with the corresponding connecting holes, respectively. The main header section may be inserted in the corresponding connecting hole, or the main header section may be butted with the corresponding connecting hole (the main header section do not extend into the corresponding connecting hole).

Certainly, the above embodiments are merely some specific examples of the present disclosure, and are not intended to limit the protection scope of the present disclosure.

The connecting header sections 12 of different forms are convenient for different design requirements. For example, the arc connecting header section 12 may facilitate the flow of the refrigerant in the header assembly 1, and has better advantages in the molding of the connecting pipe.

In addition, the connecting header section 12 and the main header sections 11 may be connected by butting or socket joint. Butting means that the main header section 11 is connected to the connecting header section 12 (which may be welded or bolted connection, etc.), but the end of the main header section 11 is not inserted into the connecting header section 12. Socket joint means that the connecting header section 12 extends into the main header section 11, or the main header section 11 extends into the connecting header section 12, and then they are connected by means of welding, thread fit, etc. Certainly, the header assembly may also be formed by bending a straight pipe, and the bent portion is the connecting header section 12.

For the connection between the connecting header section 12 and the main header section 11 by butting, socket joint or in other manners, a hydraulic diameter of the connecting header section 12 may be the same with or different from that of the main header section 11.

Embodiment 5

In the above embodiments, the header assembly 1 may include a plurality of header groups 102. The plurality of header groups 102 may be partially communicated, fully communicated or completely not communicated. That is, at least a part of the plurality of header groups 102 are communicated or isolated (not communicated) from one another. In other words, in the plurality of header groups 102, one header group 102 is communicated or not communicated with another header group 102.

Figure 4:
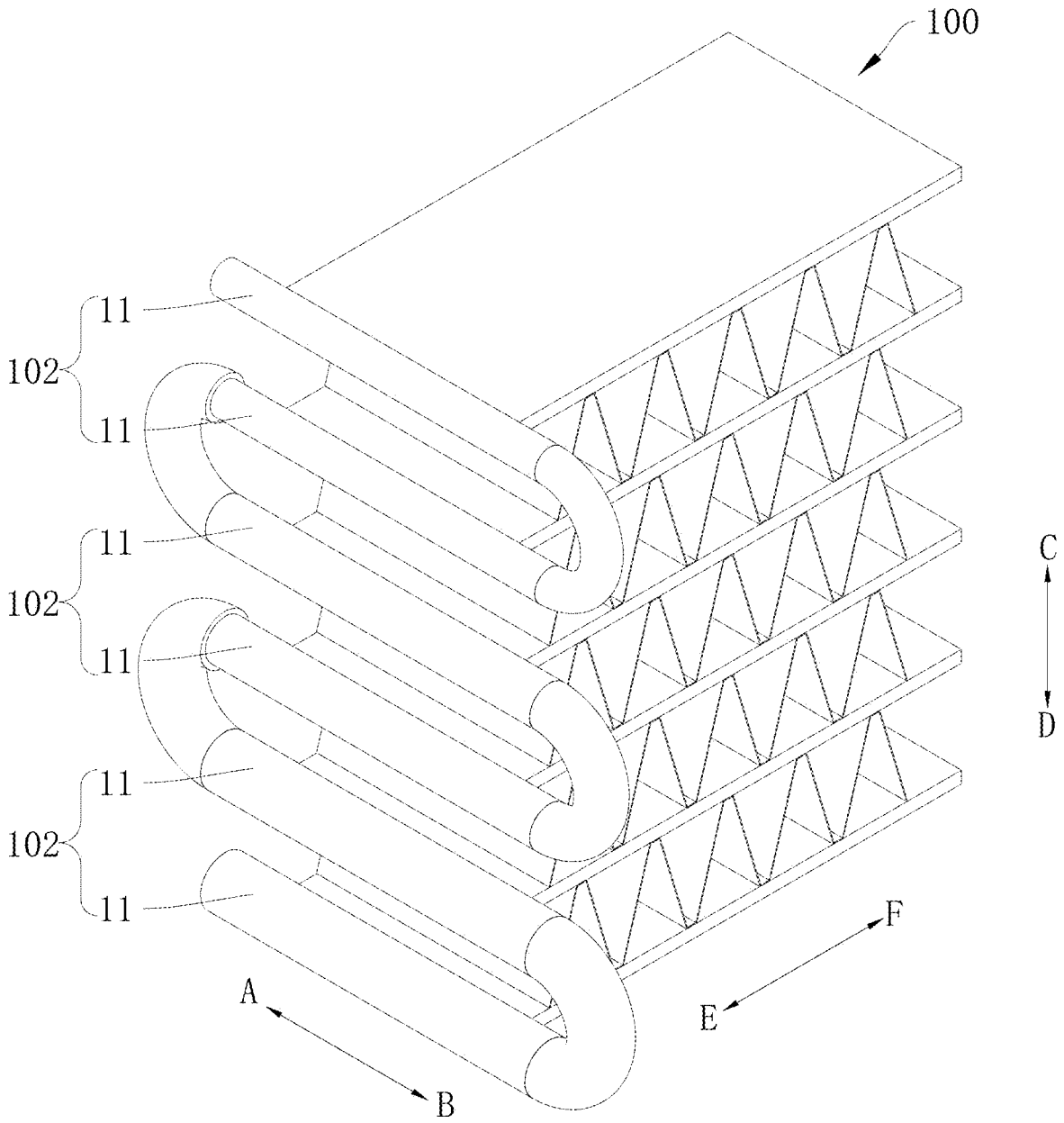
FIG. 4 is a schematic view of a heat exchanger according to another embodiment of the present disclosure.

In addition, as illustrated in FIG. 4, the plurality of header groups 102 may also be sequentially communicated along the second direction (C→D).

In some embodiments, along the second direction (C→D), the hydraulic diameter of the main header section 11 in a downstream header group 102 is no greater than (or no less than) that of the main header section 11 in an upstream header group 102.

Besides, the hydraulic diameters of the plurality of header groups 102 may gradually increase (or gradually decrease) along the second direction (C→D).

Embodiment 6

In the above embodiments, the hydraulic diameters of the main header sections 11 in the header group 102 gradually change, that is, the hydraulic diameter of one header section 11 is different from that of another main header section adjacent thereto. For example, along a certain direction, the hydraulic diameter of a downstream main header section 11 in the header group 102 is no greater than (or no less than) that of an upstream main header section 11. The upstream and downstream are defined by taking a flow direction of the refrigerant as a reference.

In some embodiments, in some embodiments of the present disclosure, the hydraulic diameters of the plurality of main header sections 11 along the second direction are the same or gradually increase (or gradually decrease).

Figure 1:
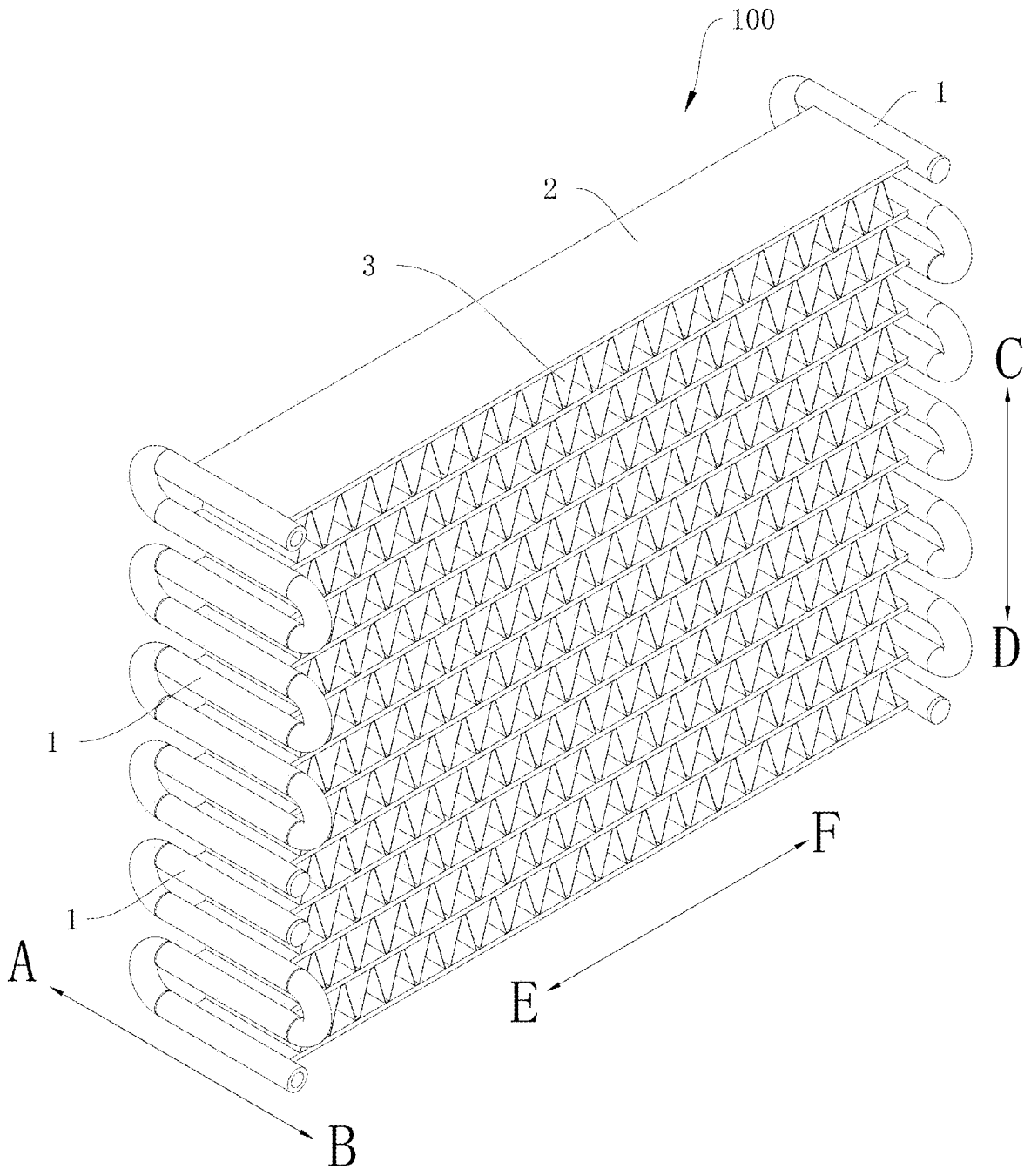
FIG. 1 is a schematic view of a heat exchanger according to an embodiment of the present disclosure.
Figure 2:
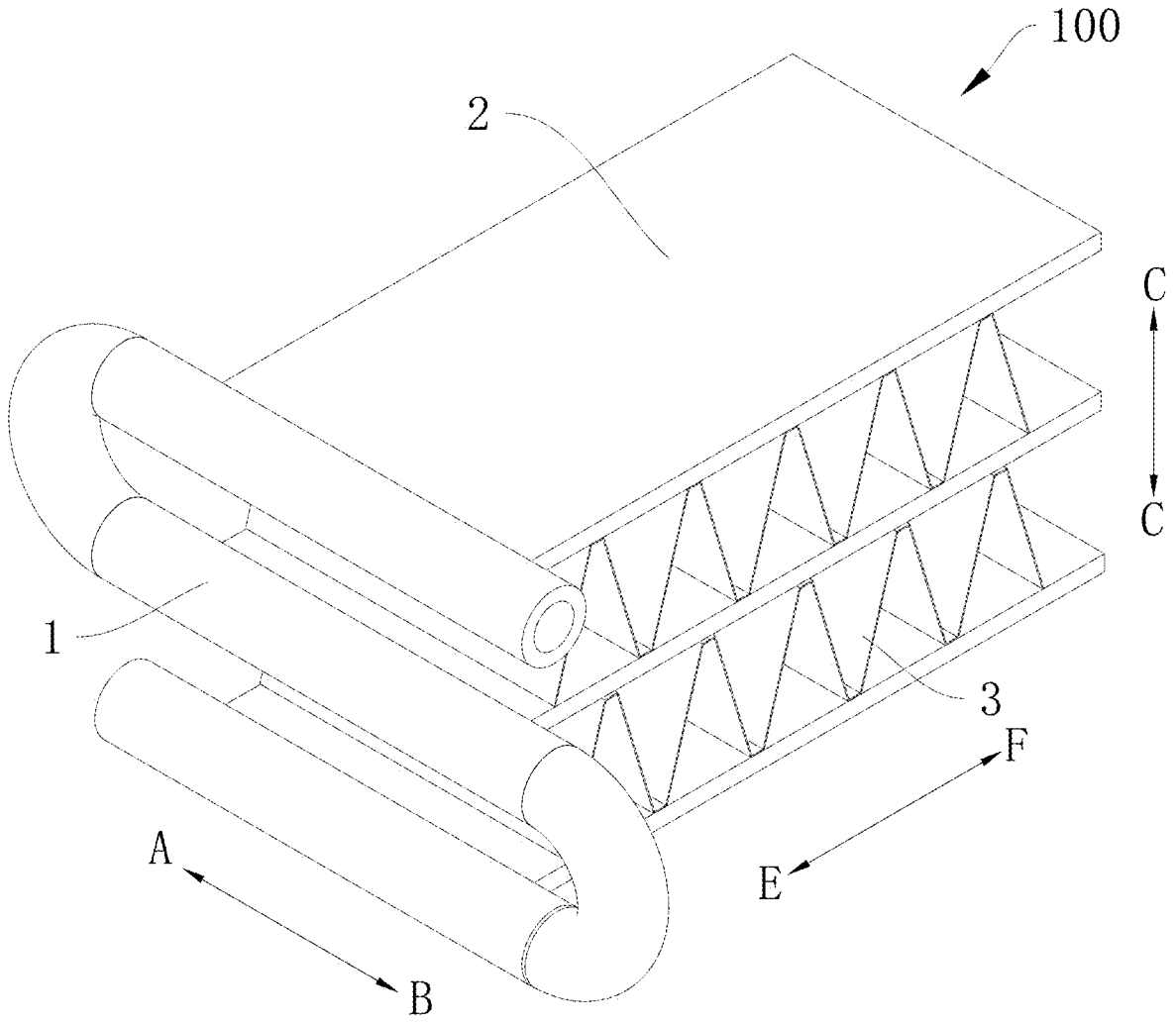
FIG. 2 is a schematic view of a heat exchanger according to another embodiment of the present disclosure.
Figure 3:
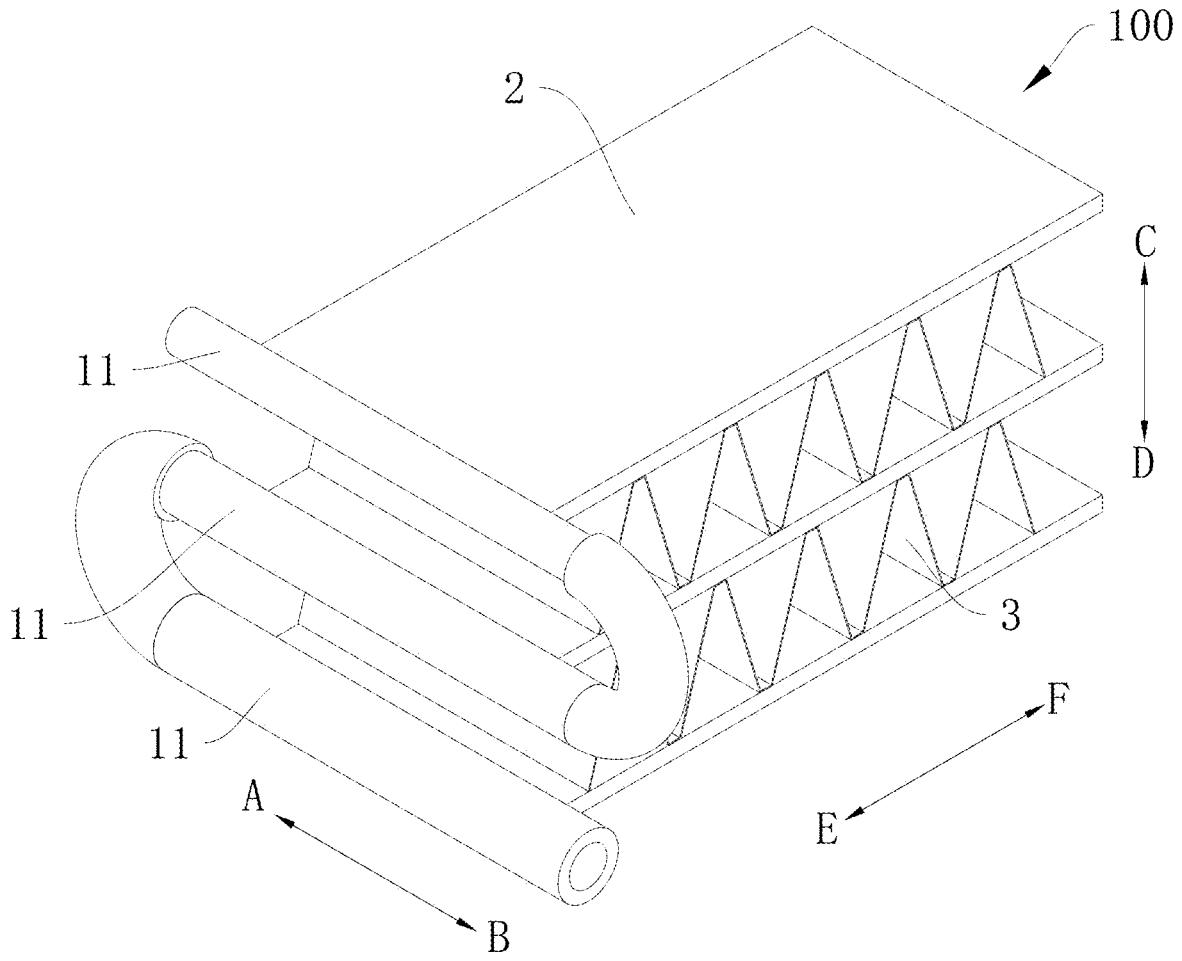
FIG. 3 is a schematic view of a heat exchanger according to another embodiment of the present disclosure.

In FIG. 1 to FIG. 2, the hydraulic diameters of the plurality of main header sections 11 in the header group 102 are all the same, and in FIG. 3 to FIG. 4, the hydraulic diameters of the plurality of main header sections 11 in the header group 102 gradually increase. This facilitates the uniform distribution of the refrigerant.

In addition, a part of the hydraulic diameters of the plurality of main header sections 11 in the header group 102 may be different and another part thereof may the same.

Furthermore, the header assembly may include a plurality of header groups 102, and the hydraulic diameters of the plurality of header groups 102 gradually change. That is, the hydraulic diameter of one header group 102 is different from that of another header group 102. The sizes of the plurality of main header sections 11 in each header group 102 may be obtained with reference to the previous descriptions.

It should be noted that the serpentine shape refers to a form of reciprocating extensions, for example, extending from one end by a certain length in a direction, then extending by a certain length in another direction opposite to said direction, and then extending reversely again in the said direction.

Certainly, the circuitous header assembly 1 may also have a shape of spiral extension, etc. The plurality of main header sections 11 in the header group 102 may be spaced apart and parallel to one another. The combination of the main header section 11 and the connecting header section 12 may facilitate the molding of the header assembly 1 and improve the molding efficiency of the header assembly 1.

In some embodiments, the flat tubes 2 and other components in the heat exchanger 100 may be mounted to the main header sections 11. Therefore, the main header sections 11 parallel to one another may be easily connected to the flat tubes 2.

Further, the through groove 101 is formed in the main header section 11, and the through grooves 10 formed in the plurality of main header sections 11 may be located on the same side. Moreover, the plurality of main header sections 11 are spaced apart from one another along the second direction, so as to be connected with the flat tubes 2 easily. The main header section 11 is provided with the through groove. In the process of connecting the flat tubes 2, the flat tubes 2 may be conveniently connected to the through grooves 101, thus improving the mounting efficiency and stability of the flat tubes 2.

In addition, the through grooves 101 may be formed in different sides of the main header section 11.

The present disclosure further provides a heat exchanger 100.

Referring to FIG. 1 to FIG. 18, the heat exchanger 100 according to the embodiments of the disclosure includes at least one heat exchange group. The heat exchange group includes a plurality of flat tubes 2 and a header assembly 1.

The plurality of flat tubes 2 are spaced apart from one another and a fin 3 is arranged between two adjacent flat tubes 2. The header assembly 1 is connected with the plurality of flat tubes 2, respectively. The header assembly 1 is the header assembly 1 for the heat exchanger 100 according to the above embodiments, and the flat tubes 2 are connected to the corresponding through grooves 101 of the header assembly 1.

The heat exchanger 100 according to the embodiments of the present disclosure employs the header assembly 1 described above, which can avoid effects of the width of the flat tube 2 on the size of the header assembly 1.

Since the present disclosure avoids the effects of the width of the flat tube 2 on the hydraulic diameter of the header assembly 1, the diameter of the header assembly 1 can be greatly reduced, and the weight and size of the header assembly 1 can also be reduced, thereby reducing the used materials and being more environmentally friendly. Moreover, the refrigerant charge can also be reduced accordingly.

In addition, the diameter of the header assembly 1 is greatly reduced, thus reducing a windward area of the header assembly 1. This area may be converted into an effective heat exchange area. Moreover, the area of the overall pipe wall is greatly reduced, and the thickness of the pipe wall can be reduced under the condition of meeting the same strength requirements. In addition, since the hydraulic diameter of the header assembly 1 is reduced, the refrigerant charge can be greatly reduced.

In the heat exchange group, there may be a variety of diversion forms, as long as a flow path can be formed.

For example, the plurality of flat tubes 2 may be connected to the header assembly 1 at one ends, and the other ends of the plurality of flat tubes 2 are communicated (through the header assembly 1, in a direct communication or through other structures). Or, two ends of the plurality of flat tubes 2 are connected to different header assemblies 1, respectively. The "different header assemblies 1" means that they are not the same header assembly 1, and the structures and shapes of the header assemblies 1 may be identical or different.

In addition, the present disclosure also provides many different embodiments for the heat exchanger 100. Certainly, the protection scope of the present disclosure is not merely limited thereto.

Embodiment 7

In the heat exchange group, a plurality of flat tubes are arranged and spaced apart from one another along a thickness direction (a direction C-D) of the flat tube, and the plurality of flat tubes 2 are divided into a first flat tube group and a second flat tube group. On one side (one side along the third direction) of the heat exchange group, ends of the first flat tube group are connected to a first header assembly, and ends of the second flat tube group are connected to a second header assembly.

It should be noted that, on the other side of the heat exchange group, the first flat tube group and the second flat tube group may be connected to the same header assembly or different header assemblies. Or, on the other side of the heat exchange group, the first flat tube group and the second flat tube group may be directly communicated with each other (not necessarily through the header assembly), etc.

Embodiment 8

In Embodiment 7, a flat tube 2 in the second flat tube group is arranged between two adjacent flat tubes (adjacent in the direction C→D) in the first flat tube group. In other words, the plurality of flat tubes 2 in the first flat tube group and the plurality of flat tubes 2 in the second flat tube group are staggered with and spaced apart from one another.

On the one side of the heat exchange group, an end of the flat tube 2 in the first flat tube group extends beyond an end of the flat tube 2 in the second flat tube group. In other words, in a projection along a length direction (direction E-F) of the flat tube 2, the ends of the flat tubes 2 on the one side of the heat exchange group are arranged in such a manner that the end of the flat tube 2 in the first flat tube group extends beyond the end of the flat tube 2 in the second flat tube group. Since the end of the flat tube 2 in the first flat tube group extends beyond the end of the flat tube 2 in the second flat tube group, the first header assembly connected to the first flat tube group and the second header assembly connected to the second flat tube group may be staggered with each other. That is, the first header assembly and the second header assembly are staggered along the length direction of the flat tube.

In addition, on the other side of the heat exchange group, the same header, different headers, or no headers may be provided. Therefore, on the other side of the heat exchange group, the end of the flat tube 2 in the second flat tube group extends beyond an edge of the end of the flat tube 2 in the second flat tube group; or, the end of the flat tube 2 in the first flat tube group extends beyond an edge of the end of the flat tube 2 in the second flat tube group; or, the end of the flat tube 2 in the first flat tube group is flush with the edge of the end of the flat tube 2 in the second flat tube group (along the length direction of the flat tube).

For example, the flat tube 2 in the first flat tube group and the flat tube 2 in the second flat tube group have the same length, and are offset in the third direction. For example, the flat tube 2 in the first flat tube group is offset to extend beyond the flat tube 2 in the second flat tube group along the third direction; or, the flat tube 2 in the second flat tube group is offset to extend beyond the flat tube 2 in the first flat tube group along the third direction. Since the flat tube 2 in the first flat tube group and the flat tube 2 in the second flat tube group have the same length, the two ends of the flat tube 2 in the first flat tube group are aligned with the two ends of the flat tube 2 in the second flat tube group at a starting point of offset.

In addition, the flat tube 2 in the first flat tube group and the flat tube 2 in the second flat tube group may not have the same length. For example, the two ends of the flat tube 2 in the first flat tube group extend beyond the two ends of the flat tube 2 in the second flat tube group in the third direction, respectively.

Embodiment 9

Referring to FIG. 1 to FIG. 18, in Embodiment 7, in the thickness direction of the flat tube, two flat tubes 2 of the second flat tube group are arranged in the first flat tube group at intervals of two flat tubes 2 of the first flat tube group. In other words, a pair of flat tubes 2 of the plurality of flat tubes 2 in the first flat tube group and a pair of flat tubes 2 of the plurality of flat tubes 2 in the second flat tube group are staggered and spaced apart from one another. Certainly, the first flat tube group or the second flat tube group may include one flat tube at either end.

Figure 11:
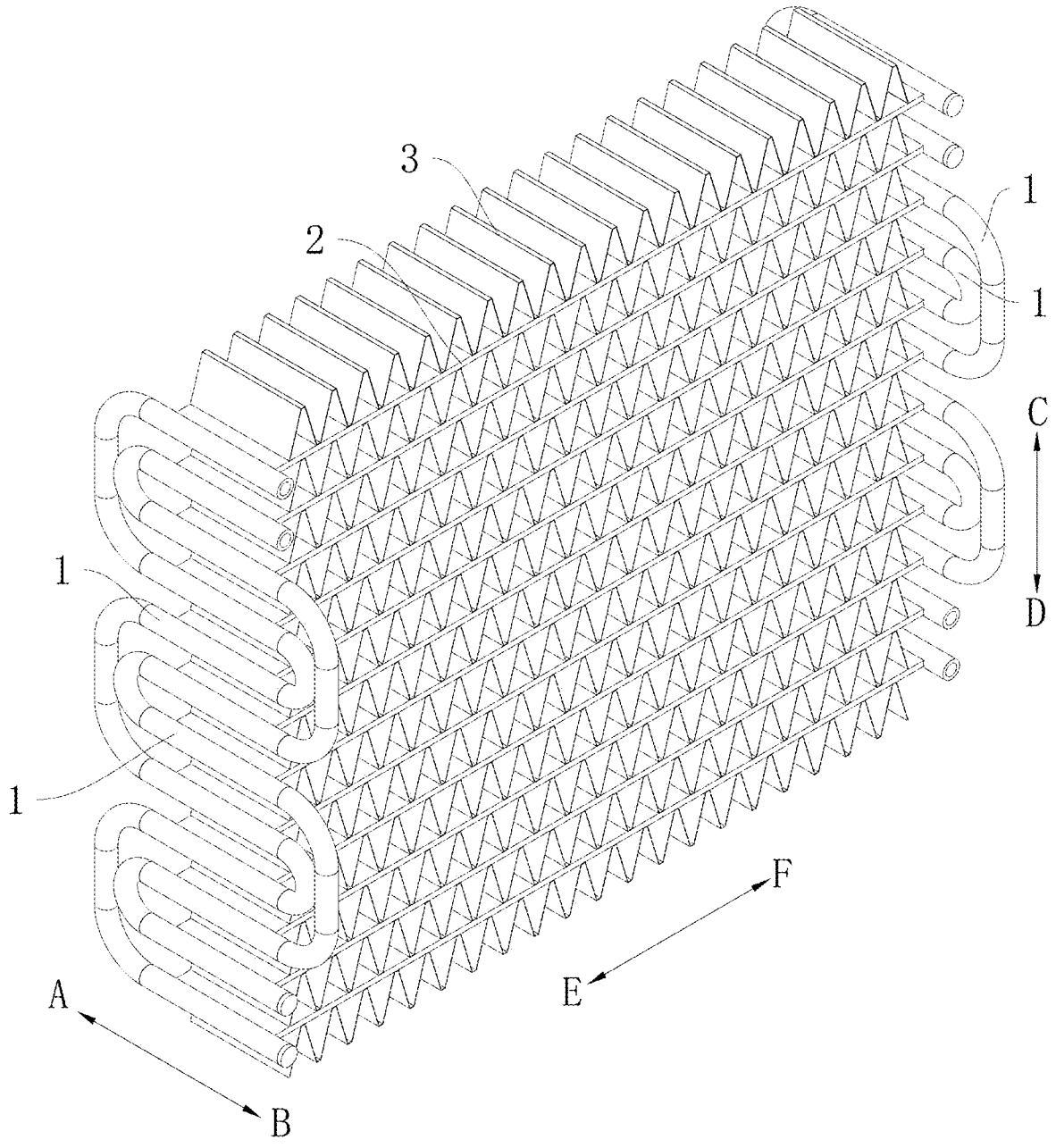
FIG. 11 is a schematic view of a heat exchanger according to another embodiment of the present disclosure.
Figure 12:
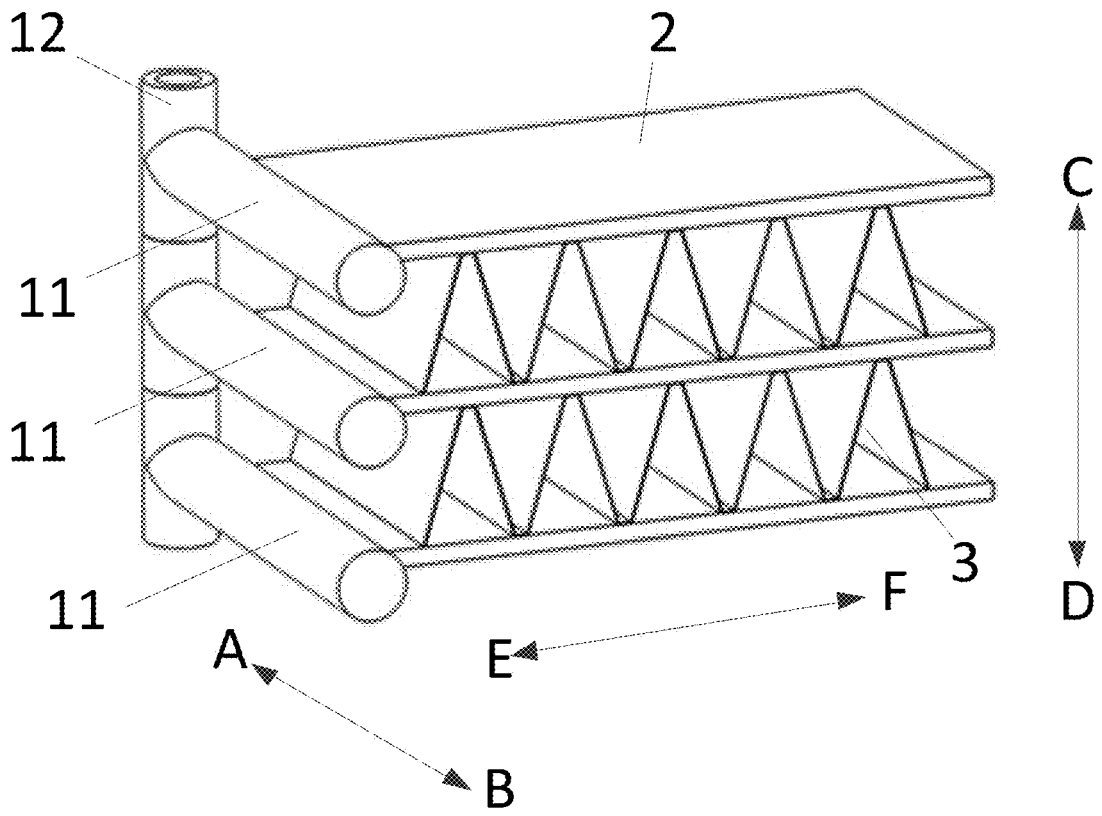
FIG. 12 is a schematic view of a heat exchanger according to another embodiment of the present disclosure.
Figure 13:
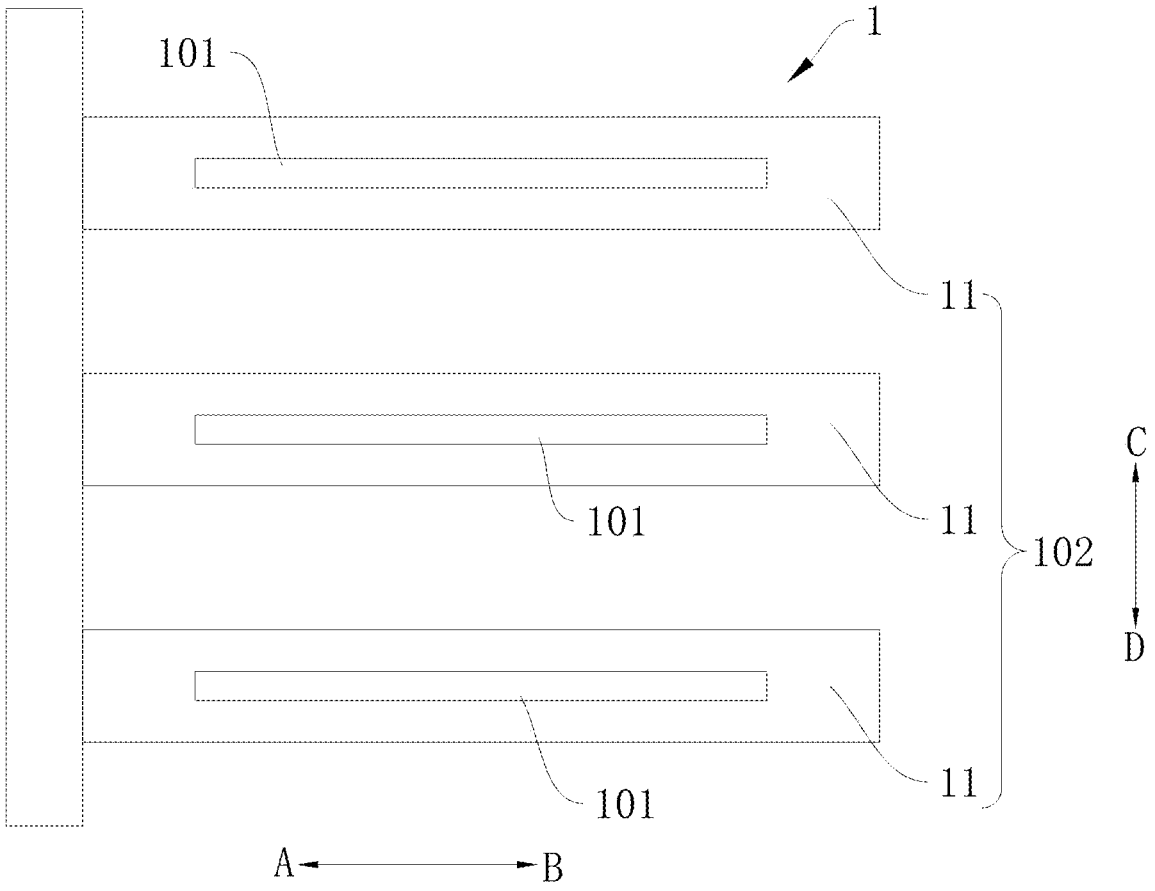
FIG. 13 is a schematic view of a header assembly for a heat exchanger according to another embodiment of the present disclosure.
Figure 14:
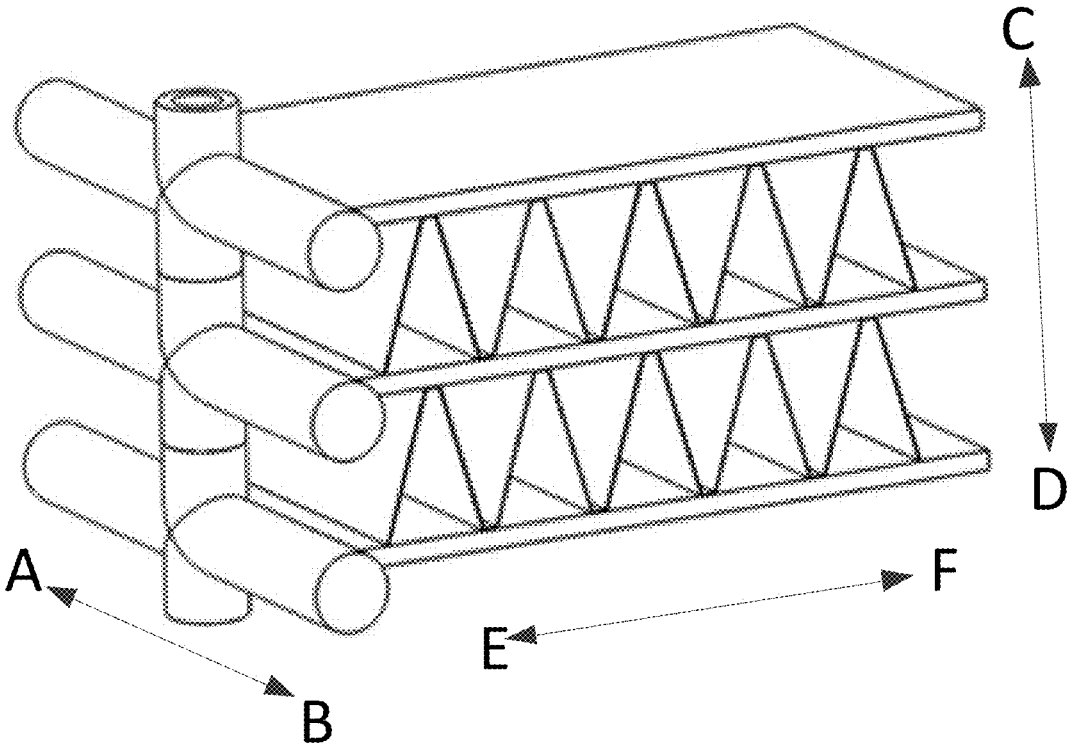
FIG. 14 is a schematic view of a heat exchanger according to another embodiment of the present disclosure.

As shown in FIG. 11, on the one side of the heat exchange group, the ends of the flat tube 2 in the first flat tube group are aligned with the ends of the flat tube 2 in the second flat tube group. Specifically, the ends of the flat tube 2 in the first flat tube group are aligned with the ends of the flat tube 2 in the second flat tube group along the length direction of the flat tube. One end of the first flat tube group is connected to a first header assembly, and one end of the second flat tube group is connected to a second header assembly. The first header assembly and the second header assembly both employ a serpentine structure, and connecting header sections 12 in the first header assembly and the second header assembly employ an elbow structure. Bending radii of adjacent elbows are different.

Therefore, the first header assembly and the second header assembly may be arranged in such a manner that center lines thereof are arranged in the same plane.

In addition, the other side of the heat exchange group may be provided with the same header, different headers, or no headers. As illustrated in FIG. 11, the header assemblies 1 of the same structure are provided on the two sides of the heat exchange group.

Embodiment 10

Figure 18:
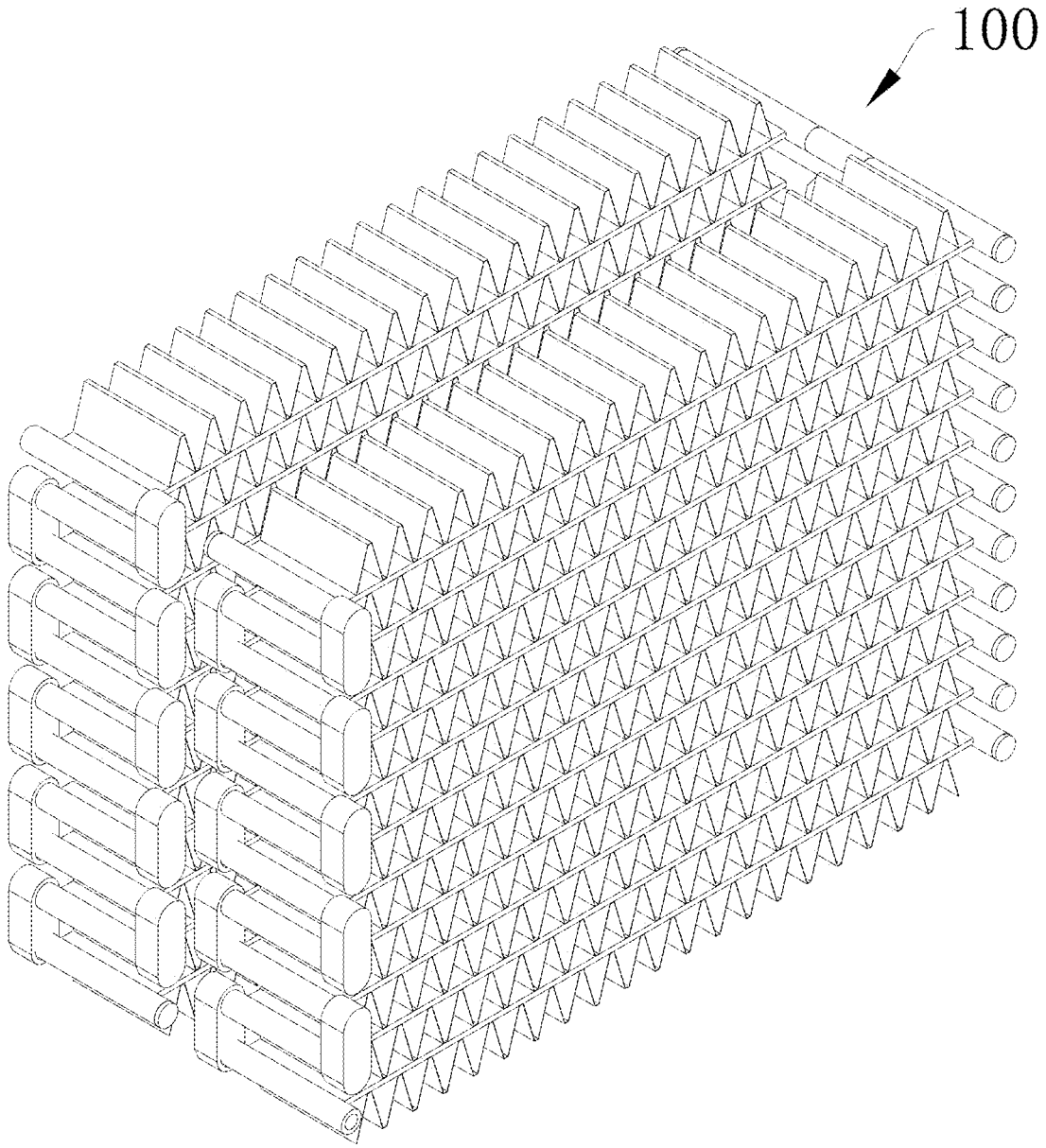
FIG. 18 is a schematic view of a heat exchanger according to another embodiment of the present disclosure.

As shown in FIG. 18, a plurality of heat exchange groups may be provided in the present disclosure. For example, the heat exchanger includes a first heat exchange group and a second heat exchange group. The first heat exchange group and the second heat exchange group are arranged along a width direction (a direction A-B) of the flat tube. That is, the first heat exchange group and the second heat exchange group form a double-row structure. One side of the first heat exchange group is connected to a header assembly, one side of the second heat exchange group is connected to another header assembly, and the other side of the first heat exchange group and the other side of the second heat exchange group are communicated through several round pipes extending along the width direction of the flat tube.

The first heat exchange group and the second heat exchange group may be arranged in the width direction of the flat tube. In this case, the above fins may also be arranged between the first heat exchange group and the second heat exchange group.

In addition, the first heat exchange group and the second heat exchange group may also be arranged in the length direction of the flat tube.

Embodiment 11

In an embodiment of the present disclosure, the two ends of the flat tube 2 are both connected to the header assembly 1. That is, the two ends of the flat tubes 2 are connected to the through grooves 101 of different header assemblies 1, respectively. The present disclosure employs the header assembly 1 described above. Thus, the hydraulic diameter of the header assembly 1 is no longer affected by the flat tube 2, so that the size of the header assembly 1 can be reduced. The space occupied by the header assembly 1 whose hydraulic diameter is decreased may be reduced, and the size of the heat exchanger 100 can be reduced after the hydraulic diameter of the header assembly 1 is reduced. Moreover, the flat tube 2 and the fin 3 which have a larger area can be provided without changing the size of the heat exchanger 100, so as to improve the heat exchange efficiency.

Specifically, the heat exchange group includes a plurality of flat tubes 2 and a header assembly 1. The plurality of flat tubes 2 are spaced apart from one another and a fin 3 is arranged between two adjacent flat tubes 2. Two ends of the flat tube 2 are both connected to one header assembly 1. The header assemblies 1 connected to the two ends of the flat tubes 2 are combined into a pair of header assemblies 1. In other words, a pair of header assemblies 1 are connected to the two ends of the flat tubes 2, respectively. The main header section 11 of the header assembly 1 is connected to the flat tube 2, and the flat tube 2 is communicated with the through groove 101 in the main header section 11 of the header assembly 1 (the end of the flat tube 2 may be inserted into the through groove 101).

In this way, the refrigerant may flow into one header assembly 1 and be distributed to different flat tubes 2 via the through grooves 101 in the plurality of main header sections 11. The refrigerant conducts the heat exchange in the flat tubes 2. After the heat exchange, the refrigerant flows into the main header sections 11 via the through grooves 101 in the other header assembly 1 at the other end of the flat tube 2 and converges through the other header assembly 1, thus forming a heat exchange passage.

The header assembly 1 may have the serpentine shape or the shape described in any of the foregoing embodiments.

In addition, the plurality of flat tubes 2 are arranged and spaced apart from one another along the thickness direction of the flat tube, and the plurality of flat tubes 2 may be divided into a plurality of flat tube groups. Ends of each flat tube group (the same ends of the flat tubes 2 in the flat tube group, for example, E ends of the flat tubes 2 in the flat tube group) are connected to the same pair of header assemblies 1. Each header assembly 1 may be any one in the foregoing embodiments, and the refrigerant distribution manner of each flat tube group and its corresponding header assembly 1 may be obtained with reference to the foregoing embodiments.

In some embodiments, a plurality of flat tube groups may be provided. Each of the plurality of flat tube groups is connected to a pair of header assemblies 1. In this way, a plurality of heat exchange passages are formed.

The plurality of heat exchange passages may be arranged in parallel. That is, the plurality of heat exchange passages are arranged parallel to one another, so as to receive the refrigerant in parallel and send the refrigerant out in parallel.

The plurality of heat exchange passages may also be arranged in series. That is, the plurality of heat exchange passages are connected in series with the refrigerant entering from one heat exchange passage and then sequentially passing through the plurality of heat exchange passages before being sent back.

Certainly, when more than three heat exchange passages are provided, the heat exchange passages may be arranged in series and also in parallel as described above. The present disclosure provides several specific embodiments (e.g., Embodiments 10 and 11), which are, of course, not intended to limit the protection scope of the present disclosure.

Figure 10:
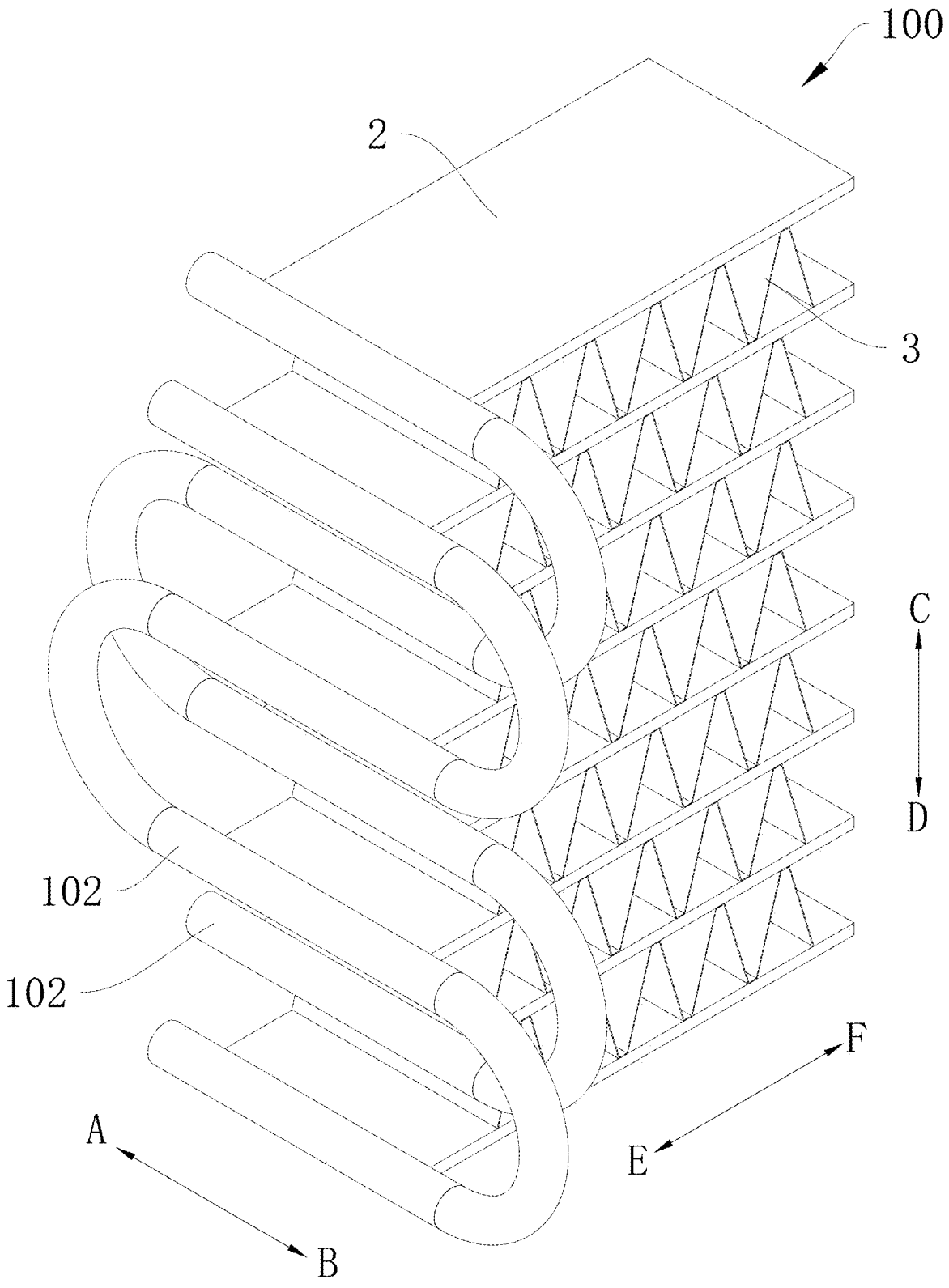
FIG. 10 is a schematic view of a heat exchanger according to another embodiment of the present disclosure.

As illustrated in FIG. 10, the heat exchange group includes a plurality of flat tubes 2 and a header assembly 1. The plurality of flat tubes 2 are spaced apart from one another, and a fin 3 is arranged between two adjacent flat tubes 2. The header assembly 1 is the header assembly 1 for the heat exchanger 100 according to the above embodiments. An end of each flat tube 2 (the same ends of the flat tubes 2 in the flat tube group, for example, an E end of the flat tube 2 in the flat tube group) is connected to the through groove 101 in the header assembly 1.

The plurality of flat tubes 2 are spaced apart from one another along the second direction (C→D), and the plurality of flat tubes 2 are divided into a first flat tube group and a second flat tube group, an end of the first flat tube group (the same ends of the flat tubes 2 in the flat tube group, for example, the E ends of the flat tubes 2 in the flat tube group) is connected to one header assembly 1, and an end of the second flat tube group (the same ends of the flat tubes 2 in the flat tube group, for example, the E ends of the flat tubes 2 in the flat tube group) are connected to the other header assembly 1.

Embodiment 12

The plurality of flat tubes 2 may be divided into a plurality of flat tube groups. Two ends of each flat tube group are both connected to the same pair of header assemblies 1. Each header assembly 1 may be any one as described above.

Since the plurality of flat tube groups are provided, and each of the plurality of flat tube groups is connected to the pair of header assemblies 1, a plurality of heat exchange passages are formed.

The plurality of heat exchange passages may be arranged in parallel. That is, the plurality of heat exchange passages are arranged parallel to one another, so as to receive the refrigerant in parallel and send the refrigerant out in parallel.

The plurality of heat exchange passages may also be arranged in series. That is, the plurality of heat exchange passages are connected in series with the refrigerant entering from one heat exchange passage and then sequentially passing through the plurality of heat exchange passages before being sent back.

Certainly, when more than three heat exchange passages are provided, the heat exchange passages may be arranged in series and also in parallel as described above. The present disclosure provides several specific embodiments (e.g., Embodiments 10 and 11), which are, of course, not intended to limit the protection scope of the present disclosure.

It can be seen from the above descriptions that the present disclosure can greatly reduce the diameter of the header assembly 1 and reduce the windward area of the header assembly 1 by more than 85% through arranging the serpentine header assembly 1 and axially amounting the flat tubes 2. This area can be converted into an effective heat exchange area. The diameter of the header assembly 1 is reduced, and the area of the overall pipe wall is greatly reduced. Moreover, the thickness of the pipe wall can be reduced under the condition of meeting the same strength requirement. The weight of the header assembly 1 can be reduced by more than 80% when the two above beneficial effects are combined. The in-pipe volume of the header assembly 1 is reduced by more than 95%, thus greatly reducing the refrigerant charge. In addition, the diameters of various sections of the header assembly 1 are changed to sequentially increase or decrease along the tube pass, thus achieving the purpose of improving the distribution of the refrigerant. Furthermore, the structure is simpler compared with the solution of an in-pipe distributor. The present disclosure makes use of the header assembly 1 to easily realize the multi-loop design of the multi-channel heat exchanger 100 so as to directly send the refrigerant through different header assemblies 1 to the corresponding flat tubes 2, thus effectively improving the distribution of the refrigerant in the flat tubes 2.

In addition, the header assembly 1 of the present disclosure may be a serpentine header assembly 1 with an elliptic section, and a header assembly 1 with a rectangular section, etc., in which the header assembly 1 with the rectangular section makes it convenient for the slotting of the flat tube 2.

In addition, in the present disclosure, the header assembly 1 may be configured in such a manner that the hydraulic diameter of the single header assembly 1 increases sequentially along the tube pass. The diameters of various sections of the header assembly 1 are changed to sequentially increase or decrease along the tube pass, thus achieving the purpose of improving the distribution of the refrigerant. Furthermore, the structure is simpler compared with the solution of the in-pipe distributor.

Similarly, the header assembly 1 may be divided into a plurality of header groups 102, and the hydraulic diameter of the header assembly 1 increases sequentially one header group by one header group along the tube pass.

When the header assembly 1 is applied to the heat exchanger 100, the multi-loop design may be employed. The header assembly 1 is used, such that it is easy to realize the multi-loop design of the multi-channel heat exchanger 100, and the refrigerant can be directly sent to the corresponding flat tubes 2 through different header assemblies 1, thus effectively improving the distribution of the refrigerant in the flat tubes 2.

In addition, it can be seen from the above that the header assembly 1 in the embodiments of the present disclosure has a small size, so that it may bring the following advantages.

Firstly, in a case that the overall size of the heat exchanger 100 is limited, the reduction of the size of the header assembly 1 results in an increase in the effective heat exchange area of the heat exchanger 100 (the flat tube 2 and the fin 3), which improves the heat exchange capability of the heat exchanger 100.

Secondly, as the diameter of the header assembly 1 decreases, the required thickness of the pipe wall may also be reduced under the condition of meeting the strength requirements. Therefore, the weight of the header assembly 1 decreases significantly and a material cost decreases accordingly.

Thirdly, the volume in the header assembly 1 decreases with the reduction of the diameter, which results in the reduction of the refrigerant charge required by the heat exchanger 100.

In the description of the present specification, reference throughout this specification to "an embodiment", "some embodiments", "example", "specific example" or "some examples" means that a particular feature, structure, material, or characteristic described in connection with the embodiment or example is included in at least one embodiment or example of the disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and different embodiments or features in the examples described in the specification, without mutual contradictions.

Although embodiments of the disclosure have been shown and illustrated, it shall be understood that the above-mentioned embodiments are exemplary and not construed as limitations to the disclosure. Various changes, modifications, alternatives and variants within the scope of the disclosure may be made by those skilled in the art.

What is claimed is:

1. A heat exchanger, comprising:

a flat tube; and a header assembly, comprising at least one header group, the header group comprising a plurality of main header sections, each the main header section being provided with at least one through groove, the through groove extending in a same direction as an axis of the main header section and in communication with the flat tube, and the plurality of main header sections in the header group being communicated with one another, in the header group, the main header section and the corresponding at least one through groove extending along a first direction, and the plurality of main header sections being sequentially arranged along a second direction, wherein an included angle between the first direction and the second direction is greater than 0°.

2. The heat exchanger according to claim 1, wherein the plurality of main header sections in the header group are end-to-end connected sequentially to form a circuitous fluid channel.

3. The heat exchanger according to claim 1, wherein the header assembly comprises a plurality of header groups communicated by a connecting header section extending along the second direction, and the plurality of header groups are arranged around the connecting header section.

4. The heat exchanger according to claim 1, wherein the header assembly comprises a plurality of header groups, and at least a part of the plurality of header groups are communicated or isolated from one another.

5. The heat exchanger according to claim 1, wherein hydraulic diameters of the main header sections in the header group gradually change.

6. The heat exchanger according to claim 1, wherein the included angle between the first direction and the second direction ranges from 30° to 90°; and the main header section is provided with a plurality of through grooves spaced apart from one another along the first direction.

7. A heat exchanger, comprising at least one heat exchange group, and the heat exchange group comprising:

a plurality of flat tubes spaced apart from one another;

a fin arranged between two adjacent flat tubes; and a header assembly, the header assembly comprising:

at least one header group, the header group comprising a plurality of main header sections, each the main header section being provided with at least one through groove, the through groove extending in a same direction as an axis of the main header section, and the plurality of main header sections in the header group being communicated with one another, in the header group, the main header section and the corresponding at least one through groove extending along a first direction, and the plurality of main header sections being sequentially arranged along a second direction, wherein an included angle between the first direction and the second direction is greater than 0° wherein an end of the each flat tube is communicated with a corresponding through groove in the header assembly.

8. The heat exchanger according to claim 7, wherein in the heat exchange group, the plurality of flat tubes are spaced apart from one another along a thickness direction of the flat tube and are divided into a first flat tube group and a second flat tube group, and on one side of the heat exchange group, an end of the first flat tube group is connected to a first header assembly, and an end of the second flat tube group is connected to a second header assembly, wherein one flat tube in the second flat tube group is arranged between two adjacent flat tubes in the first flat tube group, the end of the flat tube in the first flat tube group extends beyond the end of the flat tube in the second flat tube group on the one side of the heat exchange group, and the first header assembly and the second header assembly are staggered along a length direction of the flat tube.

9. The heat exchanger according to claim 7, wherein the heat exchanger comprises a first heat exchange group and a second heat exchange group, one side of the first heat exchange group is connected to one header assembly, one side of the second heat exchange group is connected to the other header assembly, and the other side of the first heat exchange group is in communication with the other side of the second heat exchange group.

10. The heat exchanger according to claim 9, wherein the first heat exchange group and the second heat exchange group are arranged in a width direction, a length direction or a thickness direction of the flat tube.

11. The heat exchanger according to claim 7, wherein in the heat exchange group, the plurality of flat tubes are spaced apart from one another along a thickness direction of the flat tube and are divided into a first flat tube group and a second flat tube group, and on one side of the heat exchange group, an end of the first flat tube group is connected to a first header assembly, and an end of the second flat tube group is connected to a second header assembly, two flat tubes in the second flat tube group are arranged between two adjacent flat tubes in the first flat tube group, the end of the flat tube in the first flat tube group is aligned with the end of the flat tube in the second flat tube group in a length direction of the flat tube on the one side of the heat exchange group, and the first header assembly and the second header assembly are arranged in a same plane.

12. The heat exchanger according to claim 1, wherein the plurality of main header sections in the header group are connected by a same connecting header section.

13. The heat exchanger according to claim 1, wherein the header assembly comprises a plurality of header groups, and hydraulic diameters of the plurality of header groups gradually change.

14. The heat exchanger according to claim 1, wherein the included angle between the first direction and the second direction ranges from 30° to 90°; and the main header section is provided with a plurality of through grooves spaced apart from one another along a direction around the axis thereof.

15. The heat exchanger according to claim 1, wherein the included angle between the first direction and the second direction ranges from 30° to 90°;

the main header section is provided with a plurality of through grooves spaced apart from one another along the first direction; and the plurality of through grooves are further spaced apart from one another along a direction around the axis thereof.

16. A header assembly for a heat exchanger, comprising:

at least one header group, the header group comprising a plurality of main header sections, the main header section being provided with at least one through groove, the through groove extending in a same direction as an axis of the main header section, and the plurality of main header sections in the header group being communicated with one another, in the header group, the main header section extending along a first direction, and the plurality of main header sections being sequentially arranged along a second direction, wherein an included angle between the first direction and the second direction is greater than 0°, wherein hydraulic diameters of the main header sections in the header group gradually change.

17. The header assembly for the heat exchanger according to claim 16, wherein the plurality of main header sections in the header group are end-to-end connected sequentially to form a circuitous fluid channel.

18. The header assembly for the heat exchanger according to claim 16, wherein the header assembly comprises a plurality of header groups communicated by a connecting header section extending along the second direction, and the plurality of header groups are arranged around the connecting header section.

19. The header assembly for the heat exchanger according to claim 16, wherein the header assembly comprises a plurality of header groups, and at least a part of the plurality of header groups are communicated or isolated from one another.

20. The header assembly for the heat exchanger according to claim 1, wherein the included angle between the first direction and the second direction ranges from 30° to 90°; and the main header section is provided with a plurality of through grooves spaced apart from one another along the first direction.

* * * * *